US012173380B2

(12) United States Patent
Tsukamoto et al.

(10) Patent No.: US 12,173,380 B2
(45) Date of Patent: Dec. 24, 2024

(54) STEEL SHEET AND METHOD FOR PRODUCING SAME

(71) Applicant: NIPPON STEEL CORPORATION, Tokyo (JP)

(72) Inventors: Eriko Tsukamoto, Tokyo (JP); Kengo Takeda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/035,066

(22) PCT Filed: Dec. 24, 2021

(86) PCT No.: PCT/JP2021/048346
§ 371 (c)(1),
(2) Date: May 2, 2023

(87) PCT Pub. No.: WO2022/149502
PCT Pub. Date: Jul. 14, 2022

(65) Prior Publication Data

US 2024/0011114 A1 Jan. 11, 2024

(30) Foreign Application Priority Data

Jan. 7, 2021 (JP) ..... 2021-001682

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0226* (2013.01); *C21D 8/0236* (2013.01);
(Continued)

(58) Field of Classification Search
None
See application file for complete search history.

(56) References Cited

U.S. PATENT DOCUMENTS

| | | | | |
|---|---|---|---|---|
| 11,274,356 | B2 * | 3/2022 | Takeda | C21D 6/008 |
| 2019/0185954 | A1 | 6/2019 | Kohsaka et al. | |
| 2021/0017620 | A1 | 1/2021 | Yokoyama et al. | |

FOREIGN PATENT DOCUMENTS

| | | | |
|---|---|---|---|
| EP | 3 725 904 | A1 | 10/2020 |
| WO | WO 2018/043453 | A1 | 3/2018 |
| WO | WO 2019/187060 | A1 | 10/2019 |

* cited by examiner

*Primary Examiner* — Daniel J. Schleis
(74) *Attorney, Agent, or Firm* — Birch, Stewart, Kolasch & Birch, LLP

(57) ABSTRACT

This steel sheet has a predetermined chemical composition, and includes, as a metallographic structure, ferrite, bainite, and pearlite in a total volume percentage of 0% or more and 50% or less, residual austenite in a volume percentage of 3% or more and 20% or less, and a remainder of fresh martensite and tempered martensite, in which residual austenite having an aspect ratio of 3.0 or more occupies 80% or more of a total residual austenite by area ratio, the steel sheet includes an internal oxide layer having a thickness of 4.0 μm or more from a surface of the steel sheet and a decarburized layer having a thickness of 10 μm or more and 100 μm or less from the surface of the steel sheet, and an amount of diffusible hydrogen included in the steel sheet is 1.00 ppm or less on a mass basis.

6 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C23C 2/06*** | (2006.01) |
| ***C23C 2/40*** | (2006.01) |

(52) U.S. Cl.

CPC ..... *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C23C 2/06* (2013.01); *C23C 2/40* (2013.01); *C21D 2211/001* (2013.01); *C21D 2211/002* (2013.01); *C21D 2211/005* (2013.01); *C21D 2211/008* (2013.01); *C21D 2211/009* (2013.01)

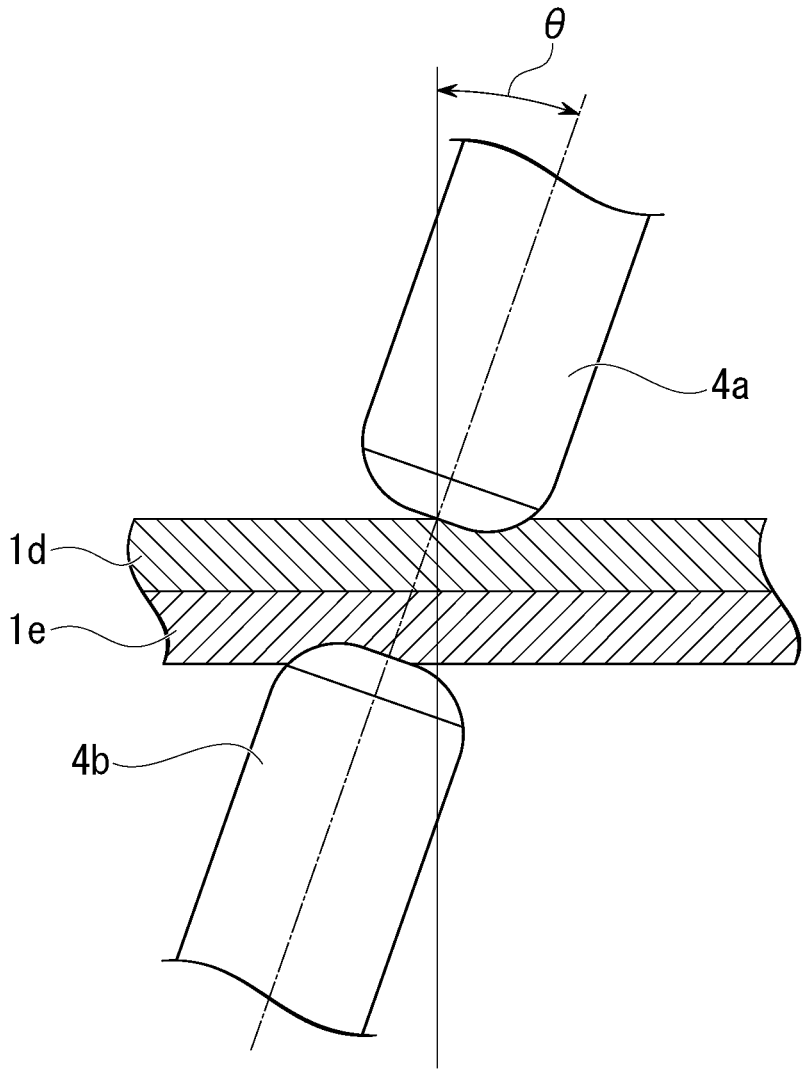
θ
4a
1d
1e
4b

STEEL SHEET AND METHOD FOR PRODUCING SAME

TECHNICAL FIELD OF THE INVENTION

The present invention relates to a steel sheet and a method for producing the same.

Priority is claimed on Japanese Patent Application No. 2021-001682, filed Jan. 7, 2021, the content of which is incorporated herein by reference.

RELATED ART

A high strength steel sheet is used as a steel sheet for a vehicle in order to reduce a weight of a vehicle, improve fuel efficiency, reduce carbon dioxide emissions, and secure the safety of passengers. In recent years, in order to sufficiently secure the corrosion resistance of a vehicle body and components, in addition to a high strength hot-dip galvanized steel sheet, a high strength hot-dip galvannealed steel sheet is also used as a steel sheet for a vehicle (for example, refer to Patent Document 1).

In addition, a high strength steel sheet used for a component for a vehicle is required to have not only strength but also properties (formability) necessary for forming components, such as uniform elongation. Although there is a trade-off relationship between strength and formability, a transformation-induced plasticity (TRIP) steel sheet which is a high strength steel sheet utilizing transformation-induced plasticity of residual austenite is known as one achieving both.

However, when galvanized steel sheets (hot-dip galvanized steel sheets, electrolytic zinc-plated steel sheets, or hot-dip galvannealed steel sheets) may be spot-welded to each other or a cold-rolled steel sheet and a galvanized steel sheet are spot-welded to each other in order to assemble a vehicle body and/or a component, cracking called liquid metal embrittlement (LME) cracking may occur in spot-welding portions. LME cracking is cracking that occurs when zinc in a galvanized layer melts due to heat generated during spot welding, molten zinc infiltrates into grain boundaries of a steel sheet microstructure in a weld, and tensile stress acts on the state. Regarding LME cracking, even if one is a cold-rolled steel sheet that is not galvanized, in a case where the other is a galvanized steel sheet, molten zinc from the galvanized steel sheet may come into contact with the cold-rolled steel sheet when spot welding is performed and causes LME cracking.

In addition. LME cracking occurs remarkably particularly when a high strength TRIP steel sheet (transformation-induced plasticity steel sheet) is spot-welded. The high strength TRIP steel sheet is a steel sheet having higher C, Si, and Mn concentrations than a normal high strength steel sheet and having excellent energy absorption capacity and press formability by containing residual austenite.

In a case of an ultrahigh-strength steel sheet having a tensile strength of more than 980 MPa, it is necessary to solve problems of not only formability but also hydrogen embrittlement cracking of the steel sheet. Hydrogen embrittlement cracking is a phenomenon in which a steel member, to which a high stress is applied in use, suddenly fractures due to hydrogen infiltrating into the steel from an environment. This phenomenon is also called delayed fracture because of the form of occurrence of fracture. It is generally known that hydrogen embrittlement cracking of a steel sheet is more likely to occur as a tensile strength of the steel sheet increases. It is considered that this is because the higher the tensile strength of the steel sheet, the greater a residual stress in the steel sheet after forming a component. Susceptibility to hydrogen embrittlement cracking (delayed fracture) is called hydrogen embrittlement resistance. In a case of a steel sheet for a vehicle, hydrogen embrittlement cracking is particularly likely to occur in a bent portion to which a large plastic strain is applied. Therefore, in a case where a high strength steel sheet is used for a vehicle member, there is a demand for an improvement in not only formability such as elongation, bendability, and hole expansibility but also the hydrogen embrittlement resistance of the bent portion. A high strength steel sheet used for a vehicle body is easily embrittled by hydrogen in steel, and is easily cracked or fractured under a low stress in a state where stress such as bending deformation is applied.

In response to such problems, for example, Patent Document 2 discloses a high strength steel sheet which is excellent in ductility and hole expansibility, is excellent in chemical convertibility and plating adhesion, and has good fatigue properties and hydrogen embrittlement resistance at a bent portion.

PRIOR ART DOCUMENT

Patent Document

[Patent Document 1] PCT International Publication No. WO2018/043453

[Patent Document 2] PCT International Publication No. WO2019/187060

DISCLOSURE OF THE INVENTION

Problems to be Solved by the Invention

However, for a vehicle, punching is performed when forming a component. As a result of an investigation by the present inventors, it has been found that in a case where the high strength steel sheet of Patent Document 2 is punched, there is a concern that hydrogen embrittlement occurs at the punched end surface even if the hydrogen embrittlement resistance of the bent portion is excellent, and the high strength steel sheet cannot meet a demand for higher collision resistance than in recent years.

As described above, in the related art, a steel sheet having high strength and being excellent in formability, collision resistance (particularly, collision resistance at a punched portion), and LME resistance during spot welding has not been disclosed.

In view of the above description, an object of the present invention is to provide a steel sheet having high strength and being excellent in formability (particularly uniform elongation), collision resistance (particularly at a punched portion), and LME resistance during spot welding, and a method for producing the same.

Means for Solving the Problem

The present invention has been made based on the above findings, and the gist thereof is as follows.

[1] A steel sheet according to an aspect of the present invention includes, as a chemical composition, by mass %: C: 0.10% to 0.40%; Si: 0.10% to 1.20%; Al: 0.30% to 1.50%; Mn: 1.0% to 4.0%; P: 0.0200% or less; S: 0.0200% or less; N: 0.0200% or less; O: 0.0200% or less; Ni: 0% to 1.00%; Mo: 0% to 0.50%; Cr: 0% to 2.00%; Ti: 0% to 0.100%; B: 0% to 0.0100%; Nb: 0% to 0.10%; V: 0% to 0.50%; Cu: 0% to 0.50%; W: 0% to 0.10%; Ta: 0% to 0.100%; Co: 0% to 0.50%; Mg: 0% to 0.050%; Ca: 0% to 0.0500%; Y: 0% to 0.050%; Zr: 0% to 0.050%; La: 0% to 0.0500%; Cc: 0% to 0.050%10; Sn: 0% to 0.05%; Sb: 0% to 0.050%; As: 0% to 0.050%; and a remainder of Fe and impurities, in which the steel sheet includes, as a metallographic structure, ferrite, bainite, and pearlite in a total volume percentage of 0% or more and 50% or less, residual austenite in a volume percentage of 3% or more and 20% or less, and a remainder of one or two of fresh martensite and tempered martensite, residual austenite having an aspect ratio of 3.0 or more occupies 80% or more of a total residual austenite by area ratio, the steel sheet includes an internal oxide layer having a thickness of 4.0 μm or more from a surface of the steel sheet and a decarburized layer having a thickness of 10 μm or more and 100 μm or less from the surface of the steel sheet, and an amount of diffusible hydrogen included in the steel sheet is 1.00 ppm or less on a mass basis.

[2] The steel sheet according to [1] may further include: a hot-dip galvanized layer on the surface.

[3] The steel sheet according to [1] may further include: a hot-dip galvannealed layer on the surface.

[4] A method for producing a steel sheet according to another aspect of the present invention includes: performing hot rolling on a slab having the chemical composition according to [1] to obtain a hot-rolled steel sheet; cooling the hot-rolled steel sheet at a cooling rate of 5° C./s or faster and coiling the hot-rolled steel sheet at 400° C. or lower; pickling the hot-rolled steel sheet after the coiling and performing cold rolling on the hot-rolled steel sheet at a rolling reduction of 0.5% or more and 20.0% or less to obtain a cold-rolled steel sheet; leaving the cold-rolled steel sheet in air for a time of 1 hour or longer and a time t represented by Expression (1) or longer; and annealing the cold-rolled steel sheet after the leaving of the cold-rolled steel sheet, in which the annealing includes subjecting the cold-rolled steel sheet to bending and bending back at 150° C. to 400° C., heating the cold-rolled steel sheet in an atmosphere having a dew point of −20° C. to 20° C., and containing 0.1 to 30.0 vol % of hydrogen and a remainder consisting of nitrogen and impurities, holding the cold-rolled steel sheet after the heating at a holding temperature of Ac1° C. to Ac3° C. for 1 second or longer and 1000 seconds or shorter, cooling the cold-rolled steel sheet after the holding to 100° C. to 340° C. at an average cooling rate of 4° C./s or faster, and reheating the cold-rolled steel sheet after the cooling and holding the cold-rolled steel sheet at 350° C. or higher and 480° C. or lower for 80 seconds or longer, $$t=-2.4\times T+96 \quad (1)$$

where T is an average temperature (° C.) during left.

[5] The method for producing a steel sheet according to 141 may further include: controlling the cold-rolled steel sheet after the annealing to a temperature range of (molten zinc bath temperature−40°) C to (molten zinc bath temperature+50° C. and immersing the cold-rolled steel sheet in a hot-dip galvanizing bath to form a hot-dip galvanized plating on a surface of the cold-rolled steel sheet.

[6] The method for producing a steel sheet according to [5] may further include: heating the hot-dip galvanized steel sheet to a temperature range of 300° C. to 500° C. to alloy a plating layer.

Effects of the Invention

According to the above aspect of the present invention, it is possible to provide a steel sheet having high strength and being excellent in formability, collision resistance, and LME resistance during spot welding, and a method for producing the same.

BRIEF DESCRIPTION OF THE DRAWINGS

FIG. 1 is a diagram describing a test method for evaluating liquid metal embrittlement cracking resistance (LME resistance).

EMBODIMENTS OF THE INVENTION

Hereinafter, a steel sheet according to an embodiment of the present invention (a steel sheet according to the present embodiment) and a method for producing the same will be described.

The steel sheet according to the present embodiment has a predetermined chemical composition described below, and has, as a metallographic structure, ferrite, bainite, and pearlite in a total volume percentage of 0% or more and 50% or less.

residual austenite in a volume percentage of 3% or mom and 20% or less, and a remainder of one or two of fresh martensite and tempered martensite.

residual austenite having an aspect ratio of 3.0 or more occupies 80% or more of the total residual austenite by area ratio, the steel sheet includes an internal oxide layer having a thickness of 4.0 μm or more from a surface of the steel sheet and a decarburized layer having a thickness of 10 μm or more and 100 μm or less from the surface of the steel sheet, and the amount of diffusible hydrogen contained in the steel sheet is 1.00 ppm or less on a mass basis.

<Metallographic Structure>

First, the metallographic structure (microstructure) of the steel sheet according to the present embodiment will be described. Hereinafter, since a microstructural fraction is represented by a volume percentage, a unit "%" of the microstructural fraction means a volume % unless otherwise specified. For those that identify the microstructural fraction by image processing, an area ratio is regarded as a volume percentage. Unless otherwise specified, the metallographic structure of the steel sheet according to the present embodiment represents a metallographic structure at a thickness ¼ portion (a ¼ thickness depth position in a sheet thickness direction from the surface). The reason for defining the metallographic structure of the thickness ¼ portion is that, in the sheet thickness direction, in the vicinity of the surface and in the vicinity of a center of the sheet thickness, the microstructures (constituent elements) of the steel sheet may differ greatly from the other portions due to decarburization and due to Mn segregation, respectively, and the metallographic structure of the thickness ¼ portion is a representative microstructure of the steel sheet.

[Ferrite, Bainite and Pearlite: 0% to 50% in Total]

Ferrite is a soft microstructure, and is thus a microstructure that is easily deformed and contributes to an improvement in elongation. However, in order to obtain a desired high strength, it is necessary to limit a volume percentage of ferrite.

Bainite is a microstructure obtained by performing holding at 350° C. or higher and 450° C. or lower for a certain period of time after annealing. Bainite is softer than martensite and is thus a microstructure that contributes to the improvement in elongation. However, in order to obtain a desired high strength, it is necessary to limit a volume percentage as in ferrite.

Pearlite is a microstructure that contains a hard iron carbide and is an origin of the generation of voids during hole expansion.

For the above reasons, in the steel sheet according to the present embodiment, the volume percentages of ferrite, bainite, and pearlite are set to 50% or less in total. In order to increase the strength, the total volume percentage of ferrite, bainite, and pearlite may be set to 40% or less in total. Ferrite, bainite, and pearlite are not essential to obtain the effects of the present embodiment, and thus a lower limit thereof is 0%.

[Residual Austenite: 3% to 20%]

Residual austenite is a microstructure that contributes to the improvement in elongation (particularly uniform elongation) by a TRIP effect. In order to obtain this effect, a volume percentage of residual austenite is set to 3% or more. The volume percentage of the residual austenite is preferably 5% or more, and more preferably 7% or more.

On the other hand, when the volume percentage of the residual austenite becomes excessive, a grain size of residual austenite increases. Such residual austenite having a large grain size becomes coarse and hard martensite after deformation. In this case, residual austenite tends to become an origin of cracking and results in deterioration of hole expansibility, which is not preferable. Therefore, the volume percentage of residual austenite is set to 20% or less. The volume percentage of residual austenite is preferably 18% or less, and more preferably 16% or less.

Further, in the steel sheet according to the present embodiment, as will be described later, not only the volume percentage of residual austenite but also an aspect ratio of residual austenite is controlled to improve stability of residual austenite. High stability of residual austenite can suppress strain-induced transformation into fresh martensite, which is a hard phase, so that the uniform elongation is improved.

[Remainder: Fresh Martensite and/or Tempered Martensite]

The remainder other than ferrite, bainite, pearlite, and residual austenite described above consists of one or two of fresh martensite and tempered martensite.

Fresh martensite is a hard microstructure having a high dislocation density, and is thus a microstructure that contributes to an improvement in tensile strength.

Similar to fresh martensite, tempered martensite is an aggregate of lath-shaped grains and is a microstructure that contributes to the improvement in tensile strength. On the other hand, tempered martensite is a hard microstructure containing fine iron-based carbides inside due to tempering, unlike fresh martensite.

Tempered martensite is obtained by tempering fresh martensite produced by cooling or the like after annealing by a heat treatment or the like.

Considering the volume percentages of ferrite, bainite, pearlite, and residual austenite, a total volume percentage of fresh martensite and tempered martensite is 30% to 97%.

Identification of ferrite, bainite, pearlite, residual austenite, fresh martensite, and tempered martensite in the metallographic structure and a calculation of the volume percentages will be described.

The volume percentage of residual austenite can be calculated by measuring a diffraction intensity using X-rays.

In the measurement using X-rays, a sample cut out from the steel sheet is mechanical polished and chemical polished so that a portion from the surface to the ¼ thickness depth position is removed, X-ray diffraction is performed on the polished surface (¼ depth position) using MoKα radiation, and a microstructural fraction of residual austenite is calculated from integrated intensity ratios of diffraction peaks of (200) and (211) of a bcc phase and (200), (220), and (311) of an fcc phase. A 5 peaks method is used as a general calculation method.

The volume percentage of fresh martensite is obtained by the following procedure.

A sample is collected so that a sheet thickness cross section parallel to a rolling direction of the steel sheet is an observed section. The observed section of the sample is etched with a LePera etchant, and a region of 100 μm×100 μm within a range of ⅛ to ⅜ of the sheet thickness from the surface centered on the ¼ thickness depth position from the surface is observed at a magnification of 3000-fold using a field emission scanning electron microscope (FE-SEM), and the volume percentage of fresh martensite is determined from an obtained secondary electron image. In LePera corrosion, fresh martensite and residual austenite are not corroded. Therefore, an area ratio of a region that is not corroded is a total area ratio of fresh martensite and residual austenite. The area ratio of the region that is not corroded is regarded as the total area ratio of fresh martensite and residual austenite, and by subtracting the volume percentage of residual austenite measured by X-rays described above from this total area ratio, the volume percentage of fresh martensite is calculated.

The volume percentages of ferrite, bainite, pearlite, and tempered martensite can be determined from a secondary electron image obtained by observation with FE-SEM. An observed section is a sheet thickness cross section parallel to the rolling direction of the steel sheet. The observed section is subjected to polishing and nital etching, and a region of 100 μm×100 μm within a range of ⅛ to ⅜ of the sheet thickness from the surface centered on the ¼ thickness depth position from the surface is observed at a magnification of 3000-fold. By leaving a plurality of indentations around the region observed by the above-mentioned LePera corrosion, the same region as the region observed by the LePera corrosion can be confirmed.

In the observation, ferrite exhibits a uniform contrast inside grain boundaries. Bainite is an aggregate of lath-shaped grains and does not contain an iron-based carbide having a major axis of 20 nm or more, or contains an iron-based carbide having a major axis of 20 nm or more and the carbide belongs to a single variant, that is, an iron-based carbide group elongated in the same direction. Here, the iron-based carbide group elongated in the same direction means a group in which a difference in an elongation direction of the iron-based carbide group is within 5°. Tempered martensite is an aggregate of lath-shaped grains and contains an iron-based carbide having a major axis of 20 nm or more, but cementite in the microstructure has a plurality of variants. In addition, a region in which cementite is precipitated in a lamellar shape is pearlite. Based on these differences, each microstructure is identified, and the area ratio is calculated by image processing. In the present embodiment, as described above, a value obtained by calculating the area ratio by the image processing is regarded as the volume percentage.

[Ratio of Residual Austenite Having Aspect Ratio of 3.0 or More: 80 Area % or More of Total Residual Austenite]

When residual austenite is formed into an acicular shape, stability under strain is improved. Specifically, residual austenite is gradually transformed from grain boundaries into martensite, and strain is generated with this transformation. As the transformation progresses, dislocations that occur in the vicinity of grain boundaries move through the inside of grains to grain boundaries on the opposite side, and the dislocations are accumulated. In a case where the residual austenite is acicular, a distance from the vicinity of grain boundaries where the dislocations occur to the grain boundaries where the dislocations are accumulated is short. Therefore, a repulsive force is generated between the accumulated dislocations and the newly generated dislocations, and strain caused by martensitic transformation is not allowed. Since the martensitic transformation is inhibited by the above mechanism, the stability of residual austenite is improved.

In the steel sheet according to the present embodiment, residual austenite is formed into an acicular shape by a method described later. Here, residual austenite formed without shape control does not have an acicular microstructure, and the stability of each residual austenite varies. Therefore, the uniform elongation is deteriorated.

Furthermore, although hydrogen tends to remain inside austenite, acicular austenite has a larger surface area than globular austenite, and thus hydrogen diffusion inside austenite is promoted in a holding stage described later. Accordingly, the amount of diffusible hydrogen in the steel sheet can be reduced.

In the present embodiment, "residual austenite having an aspect ratio of 3.0 or more" is defined as "acicular residual austenite". When residual austenite having an aspect ratio of 3.0 or more is 80% or more of the total residual austenite, the uniform elongation is improved and hydrogen embrittlement resistance is improved. Residual austenite having an aspect ratio of 3.0 or more is preferably 83% or more, and more preferably 85% or more of the total residual austenite. An upper limit of the ratio of residual austenite having an aspect ratio of 3.0 or more to the total residual austenite is not particularly limited and is ideally 100%. The "ratio" referred to here is an area ratio as will be described later.

An upper limit of the aspect ratio of residual austenite for defining the area ratio is not limited. However, in a case where the aspect ratio is high, residual y becomes an origin of the occurrence of voids during transformation, and there is a probability that the uniform elongation decreases. Therefore, the ratio of residual austenite having an aspect ratio of 3.0 to 8.0 is preferably 80% or more.

The area ratio of residual austenite having an aspect ratio of 3.0 or more to the total residual austenite is obtained by an EBSD analysis method using FE-SEM.

Specifically, a sample in which a sheet thickness cross section parallel to the rolling direction of the steel sheet is an observed section is collected, the observed section of the sample is polished, a strain-affected layer is then removed by electrolytic polishing, and a region of 100 μm×100 μm within a range of ⅛ to ⅜ of the sheet thickness from the surface centered on the ¼ thickness depth position from the surface is subjected to EBSD analysis with a measurement step of 0.05 μm. As a magnification of the measurement, any magnification may be selected from 1000 to 9000-fold, and may be, for example, 3000-fold, which is the same as the observation of the SEM-reflected electron image. A residual austenite map is created from measured data, and residual austenite having an aspect ratio of 3.0 or more is extracted to obtain an area ratio (area of residual austenite having an aspect ratio of 3.0 or more/area of total residual austenite).

[Thickness of Internal Oxide Layer: 4.0 μm or More from Surface]

The steel sheet according to the present embodiment includes an internal oxide layer having a thickness of 4.0 μm or more from the surface (the internal oxide layer is formed to a depth of at least 4.0 μm from the surface). The internal oxide layer is a layer in which at least a part of grain boundaries is coated with an oxide of an easily oxidizable element such as Si or Mn. When the grain boundaries are coated with the oxide, it is possible to suppress the infiltration of molten metal into the grain boundaries during welding and to suppress LME cracking during welding. When the thickness of the internal oxide layer is less than 4.0 μm, the above effect cannot be sufficiently obtained. Therefore, the thickness of the internal oxide layer is set to 4.0 μm or more.

On the other hand, when the thickness of the internal oxide layer is too thick, the uniform elongation decreases. Therefore, an upper limit of the internal oxide layer is preferably set to 15.0 μm or less.

However, in a case of a plated steel sheet, the surface refers to a surface of a base steel sheet (an interface between a plating layer and the base steel sheet).

The thickness of the internal oxide layer is obtained by the following method.

When the sheet thickness of the steel sheet (in the case of a plated steel sheet, the sheet thickness of the base steel sheet) is t, a t/2 position from the surface in the sheet thickness direction is defined as a sheet thickness center C. On a sheet thickness cross section parallel to the rolling direction of the steel sheet as a measured section, a Mn concentration distribution is continuously measured by a high-frequency glow discharge emission analyzer (GDS) over a distance of 120 μm from the surface of the steel sheet as an origin toward the sheet thickness center C from the surface. Due to the formation of the internal oxide layer, solute Mn around the oxide is deficient and a Mn concentration decreases. Therefore, the Mn concentration is low in the internal oxide layer, increases from the internal oxide layer toward an inside of the sheet thickness, and becomes a constant concentration becomes constant from a certain point. Therefore, the concentration at this position at which the concentration becomes constant is taken as a representative concentration of an inside of the steel sheet. When the Mn concentration increases from the internal oxide layer toward the inside of the sheet thickness, a position at which the Mn concentration becomes 90% of the representative concentration of the inside of the steel sheet is defined as X1, and a distance from the surface of X1 is defined as the thickness of the internal oxide layer.

In a case of analysis by a high-frequency glow discharge analysis method, a known high-frequency GDS analysis method can be used. Specifically, a method is used in which analysis is performed in a depth direction while the surface of the steel sheet is sputtered in a state in which the surface of the steel sheet is in an Ar atmosphere and a glow plasma is generated by applying a voltage. In addition, an element contained in the material (steel sheet) is identified from an emission spectrum wavelength peculiar to the element that is emitted when atoms are excited in the glow plasma, and the amount of the element contained in the material is estimated from an emission intensity of the identified element. Data in the depth direction can be estimated from a sputtering time. Specifically, the sputtering time can be converted into a sputtering depth by obtaining a relationship between the sputtering time and the sputtering depth using a standard sample in advance. Therefore, the sputtering depth converted from the sputtering time can be defined as a depth of the material from the surface. In the high-frequency GDS analysis, a commercially available analyzer can be used.

[Thickness of Decarburized Layer: 10 μm or More and 100 μm or Less from Surface]

In order to improve bendability after working, softening a surface layer of the steel sheet is one of the important requirements. In order to soften the surface layer of the steel sheet, it is conceivable to provide a decarburized layer on the surface layer of the steel sheet.

In addition, when the decarburized layer is present on the surface layer of the steel sheet, the hydrogen embrittlement resistance after bending is excellent. Although a detailed mechanism by which the hydrogen embrittlement resistance after bending is excellent due to the presence of the decarburized layer is not clear, it is considered that the amount of residual austenite in a microstructure of the surface layer is reduced by decarburization, so that the amount of fresh martensite formed by strain-induced transformation during bending is reduced, and the hydrogen embrittlement resistance is improved.

In the steel sheet according to the present embodiment, in order to obtain the above effects, the steel sheet includes a decarburized layer having a thickness of 10 μm or more from the surface of the steel sheet (the decarburized layer is formed to a depth of at least 10 μm from the surface). When the thickness of the decarburized layer is less than 10 μm, the above effect cannot be sufficiently obtained. On the other hand, when the thickness of the decarburized layer exceeds 100 μm, the strength is insufficient. Therefore, the thickness of the decarburized layer is set to 100 μm or less.

The thickness of the decarburized layer is obtained by the following method.

In the steel sheet according to the present embodiment, a region (excluding the plating layer) on a surface side of the steel sheet from the deepest position where an average hardness is 80% or less with respect to an average hardness of the inside the steel sheet is defined as the decarburized layer. In the present embodiment, the average hardness of the inside of the steel sheet and the average hardness at each position in the thickness direction of the steel sheet are obtained as follows.

A sample is collected so that a sheet thickness cross section parallel to the rolling direction of the steel sheet is an observed section, and the observed section is polished to a mirror finish, and is further subjected to chemical polishing using colloidal silica to remove a processed layer of the surface layer. For the observed section of the obtained sample, using a micro-hardness tester, a Vickers indenter having a square-based pyramid shape with an apex angle of 136° is pressed against a range from a depth of 5 μm from the surface (in the case of a plated steel sheet, an interface between a base steel sheet and a plating layer) as a base point to a ⅛ thickness position from the surface at a pitch of 10 μm in the thickness direction of the steel sheet. At this time, a pressing load is set so that Vickers indentations do not interfere with each other. For example, the pressing load is 20 gf. Thereafter, a diagonal length of the indentation is measured using an optical microscope, a scanning electron microscope, or the like, and is converted into a Vickers hardness (Hv).

Next, a measurement position is moved by 10 μm or more in the rolling direction, and the same measurement is performed on a range from a position at a depth of 10 μm from the surface layer as the base point to the ⅛ thickness position. Next, the measurement position is moved again by 10 μm or more in the rolling direction, and the same measurement is performed on a range from a position at a depth of 5 μm from the surface as the base point to the ⅛ thickness position. Next, the measurement position is moved by 10 μm or more in the rolling direction, and the same measurement is performed on a range from a position at a depth of 10 μm from an outermost layer as the base point to the ⅛ thickness position. By repeating this, five Vickers hardnesses are measured at each depth position. In this manner, in effect, hardness measurement data can be obtained at a pitch of 5 μm in the depth direction. A measurement interval is not simply set to a pitch of 5 μm in order to avoid interference between the indentations. An average value of five hardnesses at the same depth position is defined as a hardness at the thickness position. By interpolating the data with a straight line, a hardness profile in the depth direction is obtained.

In addition, in a range of a ⅛ thickness to a ⅜ thickness centered on the ¼ thickness position of the observed section, at least five hardnesses are measured using a micro-hardness measuring device in the same manner as described above, and a value obtained by averaging the hardnesses is defined as the average hardness of the inside of the steel sheet.

The region on the surface side of the steel sheet from the deepest position where the average hardness is 80% or less with respect to the average hardness of the inside of the steel sheet obtained as described above is defined as the decarburized layer.

In the steel sheet according to the present embodiment, the decarburized layer defined as described above is present in a region having a thickness of 10 to 100 μm in the sheet thickness direction from the surface. In other words, the decarburized layer having a hardness of 80% or less of the average hardness of the inside of the steel sheet is present in a surface layer area of the steel sheet, and the thickness of the decarburized layer is 10 to 100 μm.

[Amount of Diffusible Hydrogen Contained in Steel Sheet: 1.00 ppm or Less]

The smaller the amount of diffusible hydrogen in the steel sheet, the better the collision resistance. In the steel sheet according to the present embodiment, the amount of diffusible hydrogen in the steel sheet is set to 1.00 ppm or less on a mass basis so as to exhibit excellent collision resistance even at high strength. When the amount of diffusible hydrogen exceeds 1.00 ppm, the collision resistance deteriorates. The amount of diffusible hydrogen is preferably 0.80 ppm or less.

The hydrogen embrittlement resistance is sometimes evaluated by a limit amount of diffusible hydrogen. However, in the steel sheet according to the present embodiment, the amount of diffusible hydrogen in the steel sheet is controlled from a viewpoint of reducing the amount of hydrogen during production.

The amount of diffusible hydrogen in the steel sheet is measured by a thermal desorption spectroscopy method using gas chromatography (temperature rising rate: 100° C./h, measured up to 300° C.), and the amount of hydrogen discharged from the steel from room temperature to 200° C. is taken as the amount of diffusible hydrogen.

Next, the reason for limiting the chemical composition of the steel sheet according to the present embodiment will be described. Hereinafter, % related to the composition means mass %.

<Chemical Composition>

C: 0.10% to 0.40%

C is an element that secures a predetermined amount of martensite (fresh martensite and tempered martensite) and improves the strength of the steel sheet. When a C content is 0.10% or more, a predetermined amount of martensite can be obtained, and a desired tensile strength can be secured. The C content is preferably 0.12% or more.

On the other hand, when the C content exceeds 0.40%, weldability and LME resistance deteriorate, and the hole expansibility deteriorates. In addition, the hydrogen embrittlement resistance also deteriorates. Therefore, the C content is set to 0.40% or less. The C content is preferably 0.35% or less.

Si: 0.10% to 1.20%

Si is an element useful for improving the strength of the steel sheet by solid solution strengthening. In addition, Si suppresses the generation of cementite, and is thus an element effective in promoting the concentration of C in austenite and generating residual austenite after annealing. In addition, Si has an effect of promoting segregation of carbon (C) on y grain boundaries in an annealing process, which will be described later. When a Si content is less than 0.10%, it becomes difficult to obtain the effect by the above action, sufficient uniform elongation cannot be obtained, and hydrogen embrittlement resistance deteriorates, which is not preferable. Therefore, the Si content is set to 0.10% or more. The Si content is preferably 0.50% or more, and more preferably 0.60% or more.

On the other hand, when the Si content exceeds 1.20%, LME cracking is likely to occur during welding, and chemical convertibility and plating properties significantly deteriorate. Therefore, the Si content is set to 1.20% or less. The Si content is preferably 1.10% or less, and more preferably 1.00% or less.

Al: 0.30% to 1.50%

Al is an element having an action of deoxidizing molten steel. In addition, like Si, Al suppresses the generation of cementite and is thus an element effective in promoting the concentration of C in austenite and generating residual austenite after annealing. In the steel sheet according to the present embodiment, the Si content is set within the above range in order to improve the LME resistance, and an Al content is set within a relatively high range in order to increase the volume percentage of residual y. Specifically, in a case where the Al content is less than 0.30%, these effects cannot be sufficiently obtained. Therefore, the Al content is set to 0.30% or more. The Al content is preferably 0.40% or more, and more preferably 0.50% or more.

On the other hand, when the Al content is too high, a coarse Al oxide is formed, and workability of the steel sheet decreases. In addition, when the Al content is high, castability deteriorates. Therefore, the Al content is set to 1.50% or less. The Al content is preferably 1.40% or less, and more preferably 1.30% or less.

Mn: 1.0% to 4.0%

Mn has an action of improving hardenability of steel and is an element effective in obtaining the metallographic structure of the present embodiment. When a Mn content is set to 1.0% or more, a desired metallographic structure can be obtained. The Mn content is preferably 1.3% or more.

On the other hand, when the Mn content is excessive, the effect of improving the hardenability is reduced due to segregation of Mn, and a material cost increases. Therefore, the Mn content is set to 4.0% or less. The Mn content is preferably 3.5% or less.

P: 0.0200% or Less

P is an impurity element, and is an element that segregates into a sheet thickness center portion of the steel sheet and causes a decrease in toughness and embrittlement of a weld. When a P content exceeds 0.0200%, weld strength and the hole expansibility significantly decrease. Therefore, the P content is set to 0.0200% or less. The P content is preferably 0.0100% or less.

The P content is preferably as small as possible and may be 0%. However, when the P content is reduced to less than 0.0001% in a practical steel sheet, a manufacturing cost increases significantly, which is economically disadvantageous. Therefore, the P content may be set to 0.0001% or more.

S: 0.0200% or Less

S is an impurity element, and is an element that lowers weldability and also lowers manufacturability during casting and hot rolling. In addition. S is also an element that forms coarse MnS and causes a decrease in the hole expansibility. When a S content exceeds 0.0200%, the weldability, the manufacturability, and the hole expansibility significantly decrease. Therefore, the S content is set to 0.0200% or less.

The S content is preferably as small as possible and may be 0%. However, when S is reduced to less than 0.0001% in a practical steel sheet, the manufacturing cost increases significantly, which is economically disadvantageous. Therefore, the S content may be set to 0.0001% or more.

N: 0.0200% or Less

N is an element that forms a coarse nitride, reduces bendability and the hole expansibility, and causes blowholes during welding. When the N content exceeds 0.0200%, a decrease in the hole expansibility and the generation blowholes become significant. Therefore, the N content is set to 0.0200% or less.

The N content is preferably as small as possible and may be 0%. However, when the N content is reduced to less than 0.0001% in a practical steel sheet, the manufacturing cost increases significantly, which is economically disadvantageous. Therefore, the N content may be set to 0.0001% or more.

O: 0.0200% or Less

O is an element that forms a coarse oxide, reduces the bendability and the hole expansibility, and causes blowholes during welding. When the O content exceeds 0.0200%, a decrease in the hole expansibility and the generation of blowholes become significant. Therefore, the O content is set to 0.0200% or less.

The O content is preferably as small as possible and may be 0%. However, when O is reduced to less than 0.0005% in a practical steel sheet, the manufacturing cost increases significantly, which is economically disadvantageous. Therefore, the O content may be set to 0.0005% or more.

In the chemical composition of the steel sheet according to the present embodiment, the remainder excluding the above elements basically consists of Fe and impurities. The impurities are incorporated from steel raw materials and/or in a steelmaking process and are elements that are allowed to be present in a range in which the characteristics of the steel sheet according to the present embodiment are not clearly deteriorated.

On the other hand, the steel sheet according to the present embodiment may further include, as the chemical composition, one or two or more selected from the group consisting of Ni: 1.00% or less, Mo: 0.50% or less, Cr: 2.00% or less, Ti: 0.100% or less, B: 0.0100% or less, Nb: 0.10% or less, V: 0.50% or less, Cu: 0.50% or less, W: 0.10% or less, Ta: 0.100% or less. Co: 0.50% or less, Mg: 0.050% or less, Ca: 0.0500% or less, Y: 0.050% or less, Zr: 0.050% or less, La:

0.0500% or less, Ce: 0.050% or less, Sn: 0.05% or less, Sb: 0.050% or less, and As: 0.050% or less. Since these elements may not be contained, lower limits thereof are 0%. In addition, within the above ranges, even if these elements are contained as impurities, the effect of the steel sheet according to the present embodiment is not impaired.

Ni: 0% to 1.00%

Ni is an element effective in improving the strength of the steel sheet. A Ni content may be 0%, but in order to obtain the above effect, the Ni content is preferably 0.001% or more. The Ni content is more preferably 0.01% or more.

On the other hand, when the Ni content is too high, there is a concern that the elongation of the steel sheet decreases and formability may decrease. Therefore, the Ni content is set to 1.00% or less.

Mo: 0% to 0.50%

Like Cr, Mo is an element that contributes to high-strengthening of the steel sheet. This effect can be obtained even in a small amount. A Mo content may be 0%, but in order to obtain the above effect, the Mo content is preferably 0.01% or more.

On the other hand, when the Mo content exceeds 0.50%, there is a concern that coarse Mo carbides are formed, and cold formability of the steel sheet decreases. Therefore, the Mo content is set to 0.50% or less.

Cr: 0% to 2.00%

Cr is an element that improves the hardenability of steel and contributes to high-strengthening, and is an element effective in obtaining the above-mentioned metallographic structure. Therefore, Cr may be contained. A Cr content may be 0%, but in order to sufficiently obtain the above effects, the Cr content is preferably set to 0.01% or more.

On the other hand, even if Cr is excessively contained, the effect of the above action is saturated, which is uneconomical. Therefore, the Cr content is set to 2.00% or less.

Ti: 0% to 0.100%

Ti is an element that contributes to an increase in the strength of the steel sheet by precipitation hardening, grain refinement strengthening by suppressing growth of ferrite grains, and/or dislocation strengthening by suppressing recrystallization. A Ti content may be 0%, but in order to sufficiently obtain the above effect, the Ti content is preferably 0.001% or more. For further high-strengthening of the steel sheet, the Ti content is more preferably 0.010% or more.

However, when the Ti content exceeds 0.100%, precipitation of carbonitrides increases and the formability deteriorates. Therefore, the Ti content is set to 0.100% or less.

B: 0% to 0.0100%

B is an element that suppresses the generation of ferrite and pearlite in the metallographic structure and promotes the generation of a low temperature transformation microstructure such as bainite or martensite in a cooling process from an austenite temperature range. In addition, B is an element useful for high-strengthening of steel. This effect can be obtained even in a small amount. A B content may be 0%, but in order to obtain the above effects, the B content is preferably set to 0.0001% or more.

On the other hand, when the B content is too high, there is a concern that a coarse B oxide is formed, and the B oxide becomes an origin of the occurrence of voids during press forming, so that the formability of the steel sheet decreases. Therefore, the B content is set to 0.0100% or less.

Nb: 0% to 0.10%

Nb is an element that contributes to an increase in the strength of the steel sheet by precipitation hardening, grain refinement strengthening by suppressing the growth of ferrite grains, and/or dislocation strengthening by suppressing recrystallization. A Nb content may be 0%, but the Nb content is preferably 0.01% or more in order to sufficiently obtain the above effects. For further high-strengthening of the steel sheet, the Nb content is more preferably 0.05% or more.

On the other hand, when the Nb content exceeds 0.10%, the precipitation of carbonitrides increases and the formability deteriorates. Therefore, the Nb content is set to 0.10% or less. From the viewpoint of formability, the Nb content is preferably 0.06% or less.

V: 0% to 0.50%

V is an element that contributes to an increase in the strength of the steel sheet by precipitation hardening, grain refinement strengthening by suppressing the growth of ferrite grains, and dislocation strengthening by suppressing recrystallization. AV content may be 0%, but in order to sufficiently obtain the above effects, the V content is preferably 0.01% or more, and more preferably 0.02% or more.

However, when the V content exceeds 0.50%, carbonitrides are excessively precipitated and the formability deteriorates. Therefore, the V content is set to 0.50% or less. The V content is preferably 0.40% or less.

Cu: 0% to 0.50%

Cu is an element that contributes to an improvement in the strength of the steel sheet. This effect can be obtained even in a small amount. A Cu content may be 0%, but in order to obtain the above effect, the Cu content is preferably 0.01% or more.

On the other hand, when the Cu content is too high, there is a concern that productivity in hot rolling decreases due to hot shortness. Therefore, the Cu content is set to 0.50% or less.

W: 0% to 0.10%

W is an element effective in improving the strength of the steel sheet. A W content may be 0%, but in order to obtain the above effect, the W content is preferably 0.01% or more.

On the other hand, when the W content is too high, a large number of fine W carbides are precipitated, there is a concern that an excessive increase in the strength of the steel sheet causes a decrease in elongation, and cold workability of the steel sheet decreases. Therefore, the W content is set to 0.10% or less.

Ta: 0% to 0.100%

Like W, Ta is also an element effective in improving the strength of the steel sheet. A Ta content may be 0%, but in order to obtain the above effect, the Ta content is preferably 0.001% or more.

On the other hand, when the Ta content is too high, a large number of fine Ta carbides are precipitated, there is a concern that an excessive increase in the strength of the steel sheet causes a decrease in elongation, and the cold workability of the steel sheet decreases. Therefore, the Ta content is set to 0.100% or less. The Ta content is preferably 0.020% or less, and more preferably 0.010% or less.

Co: 0% to 0.50%

Co is an element effective in improving the strength of the steel sheet. A Co content may be 0%, but in order to obtain the above effect, the Co content is preferably 0.01% or more.

On the other hand, when the Co content is too high, there is a concern that the elongation of the steel sheet decreases and the formability decreases. Therefore, the Co content is set to 0.50% or less.

Mg: 0% to 0.050%

Mg is an element that controls morphology of sulfides and oxides and contributes to an improvement of bending formability of the steel sheet. Since this effect can be obtained even in a small amount, a Mg content may be 0%, but the Mg content is preferably 0.0001% or more in order to obtain the above effect.

On the other hand, when the Mg content is too high, there is a concern that the cold formability decreases due to the formation of coarse inclusions. Therefore, the Mg content is set to 0.050% or less. The Mg content is preferably 0.040% or less.

Ca: 0% to 0.0500%

Like Mg, Ca is an element capable of controlling the morphology of sulfides with a small amount. A Ca content may be 0%, but in order to obtain the above effect, the Ca content is preferably 0.0010% or more.

On the other hand, when the Ca content is too high, a coarse Ca oxide is formed, and this coarse Ca oxide may be the origin of the occurrence of cracking during cold forming. Therefore, the Ca content is set to 0.0500% or less. The Ca content is preferably 0.0400% or less, and more preferably 0.0300% or less.

Y: 0% to 0.050%

Like Mg and Ca, Y is an element capable of controlling the morphology of sulfides with a small amount. An Y content may be 0%, but in order to obtain the above effect, the Y content is preferably 0.001% or more.

On the other hand, when the Y content is too high, there is a concern that a coarse Y oxide is formed, and the cold formability deteriorates. Therefore, the Y content is set to 0.050% or less. The Y content is preferably 0.040% or less.

Zr: 0% to 0.050%

Like Mg, Ca, and Y, Zr is an element capable of controlling the morphology of sulfides with a small amount. A Zr content may be 0%, but in order to obtain the above effect, the Zr content is preferably 0.001% or more.

On the other hand, when the Zr content is too high, there is a concern that a coarse Zr oxide is formed, and the cold formability decreases. Therefore, the Zr content is set to 0.050% or less. The Zr content is preferably 0.040% or less.

La: 0% to 0.0500%

La is an element effective in controlling the morphology of sulfides with a small amount. A La content may be 0%, but in order to obtain the above effect, the La content is preferably 0.0010% or more.

On the other hand, when the La content is too high, there is a concern that a La oxide is formed, and the cold formability decreases. Therefore, the La content is set to 0.0500% or less. The La content is preferably 0.0400% or less.

Ce: 0% to 0.050%

Ce is an element capable of controlling the morphology of sulfides with a small amount and is an element that also contributes to the improvement in the LME resistance. In order to sufficiently obtain this effect, it is preferable that a Ce content is set to 0.001% or more. The Ce content may be 0.002% or more, 0.003% or more, or 0.005% or more.

On the other hand, when the Ce content is excessive, there may be cases where the steel sheet becomes embrittled and the elongation of the steel sheet decreases. Therefore, the Ce content is set to 0.050% or less. The Ce content may be 0.040% or less, 0.020% or less, or 0.010% or less.

Sn: 0% to 0.05%

Sn is an element that may be contained in the steel sheet when scrap is used as a raw material for the steel sheet. Sn has an effect of improving corrosion resistance and thus may be contained. However, Sn is an element that may cause a decrease in the cold formability of the steel sheet due to the embrittlement of ferrite. When a Sn content exceeds 0.05%, adverse effects become significant. Therefore, the Sn content is set to 0.05% or less. The Sn content is preferably 0.04% or less, and may be 0%. However, reducing the Sn content to less than 0.001% causes an excessive increase in a refining cost. Therefore, the Sn content may be set to 0.001% or more.

Sb: 0% to 0.050%

Like Sn, Sb is an element that may be contained in the steel sheet in a case where scrap is used as a raw material for the steel sheet. Sb has an effect of improving the corrosion resistance and thus may be contained. However. Sb is an element that strongly segregates at grain boundaries and may cause intergranular embrittlement, a decrease in the elongation, and a decrease in the cold formability. When a Sb content exceeds 0.050%, adverse effects become significant. Therefore, the Sb content is set to 0.050% or less. The Sb content is preferably 0.040% or less and may be 0%. However, reducing the Sb content to less than 0.001% causes an excessive increase in the refining cost. Therefore, the Sb content may be set to 0.001% or more.

As: 0 to 0.050%

Like Sn and Sb, As is an element that may be contained in the steel sheet in a case where scrap is used as a raw material for the steel sheet. As is an element that improves the hardenability of steel and may be contained. However, As is an element that strongly segregates at grain boundaries and may cause a decrease in the cold formability. When an As content exceeds 0.050%, adverse effects become significant. Therefore, the As content is set to 0.050% or less. The As content is preferably 0.040% or less, and may be 0%. However, reducing the As content to less than 0.001% cases an excessive increase in the refining cost. Therefore, the As content may be set to 0.001% or more.

The chemical composition of the steel sheet according to the present embodiment can be obtained by the following method.

The chemical composition of the steel sheet described above may be measured by a general chemical composition. For example, the chemical composition of the steel sheet described above may be measured using inductively coupled plasma-atomic emission spectrometry (ICP-AES). In addition, C and S may be measured using a combustion-infrared absorption method, N may be measured using an inert gas fusion-thermal conductivity method, and O may be measured using an inert gas fusion-non-dispersive infrared absorption method. In a case where the steel sheet is provided with a plating layer on the surface, the chemical composition may be analyzed after removing the plating layer by mechanical grinding.

A galvanized layer (hot-dip galvanized layer or electrogalvanized layer) may be formed on the surface (both sides or one side) of the steel sheet according to the present embodiment. The hot-dip galvanized layer may be a hot-dip galvannealed layer which is alloyed. A chemical composition of the hot-dip galvanized layer of the steel sheet according to the present embodiment is not particularly limited and may be a known plating layer. In addition, it is not hindered that the steel sheet according to the present embodiment has another plating (for example, aluminum plating).

In a case where the hot-dip galvanized layer is not alloyed, an Fe content in the hot-dip galvanized layer is preferably less than 7.0 mass %.

In a case where the hot-dip galvanized layer is a hot-dip galvannealed layer which is alloyed, the Fe content is preferably 6.0 mass % or more. The Fe content is more preferably 7.0 mass % or more. A hot-dip galvannealed steel sheet has better weldability than a hot-dip galvanized steel sheet.

The steel sheet according to the present embodiment may be provided with the galvanized layer, and furthermore, on the galvanized layer, an upper layer plating layer for the purpose of improving coatability, weldability, and the like. Furthermore, the galvanized steel sheet may be subjected to various treatments such as a chromate treatment, a phosphate treatment, a lubricity improvement treatment, and a weldability improvement treatment.

<Characteristics>

[Tensile Strength]

In the steel sheet according to the present embodiment, a target tensile strength (TS) is 980 MPa or more in consideration of the contribution to an improvement in fuel efficiency of a vehicle. An upper limit of the tensile strength is not particularly limited, but may be 1310 MPa or less in terms of formability.

[Uniform Elongation]

In the steel sheet according to the present embodiment, a target uniform elongation (u-El) is 7.0% or more from the viewpoint of formability. An upper limit of the uniform elongation is not particularly limited.

The tensile strength and the uniform elongation are measured by collecting a JIS No. 5 tensile test piece described in JIS Z 2241:2011 from the steel sheet in a direction perpendicular to the rolling direction and performing a tensile test in accordance with JIS Z 2241:2011.

[Collision Resistance]

The steel sheet according to the present embodiment has excellent hydrogen embrittlement resistance at a punched end surface, and thus has excellent collision resistance.

For example, assuming that a tensile strength when a semi-circular punched hole having a diameter of 10 mm is formed in central parts of both ends of the JIS No. 5 tensile test piece and is pulled in accordance with JIS Z 2241:2011 is TS1, a tensile strength when a semi-circular reamed hole having a diameter of 10 mm is formed in central parts of both ends of the JIS No. 5 tensile test piece and is pulled in accordance with JIS Z 2241:2011 is TS2, and R=TS1/TS2 is established, a value of R is preferably 0.93 or more.

[LME Resistance]

In the steel sheet according to the present embodiment, for example, when two steel sheets, at least one of which is a galvanized steel sheet, are pressed at a pressure of 450 kgf (4413 kg·m/s$^2$) using a servomotor pressure type single-phase AC spot welder (power supply frequency 50 Hz) and are subjected to spot welding with a current value of 6.5 kA, an electrode inclination angle of 3°, no upslope, an energization time of 0.4 seconds, and a hold time of 0.1 seconds after the end of energization, it is preferable that cracks having a length of 100 μm or more do not occur in a region of a nugget central part.

Next, a method for producing the steel sheet according to the present embodiment will be described.

The steel sheet according to the present embodiment can be produced by a production method including the following processes:

(I) a hot rolling process of performing hot rolling on a slab having the above-described chemical composition to obtain a hot-rolled steel sheet;

(II) a coiling process of cooling the hot-rolled steel sheet at a cooling rate of 5° C./s or faster and coiling the hot-rolled steel sheet at 400° C. or lower;

(III) a cold rolling process of pickling the hot-rolled steel sheet after the coiling process and performing cold rolling on the hot-rolled steel sheet at a rolling reduction of 0.5% or more and 20.0% or less to obtain a cold-rolled steel sheet;

(IV) a hydrogen content reducing process of leaving the cold-rolled steel sheet in air for a time of 1 hour or longer and a time t represented by Expression (1) or longer; and (V) an annealing process of annealing the cold-rolled steel sheet after the hydrogen content reducing process.

$$t=-2.4\times T+96 \quad (1)$$

where T is an average temperature (° C.) during left.

Hereinafter, preferable conditions for each process will be described. Known conditions can be applied to conditions that are not described.

[Hot Rolling Process]

In the hot rolling process, a slab having the above-described chemical composition (the same chemical composition as that of the steel sheet according to the present embodiment) is subjected to hot rolling to obtain a hot-rolled steel sheet. The slab to be subjected to the hot rolling is not particularly limited as long as the slab has the above-described chemical composition, and may be any slab manufactured by a normal method. The slab may be a slab manufactured by a general method such as a continuous casting or a thin slab caster.

In the hot rolling, rough rolling and finish rolling are performed. In the finish rolling, the slab after the rough rolling is rolled by a plurality of finishing mills. A heating temperature and a holding time of the slab before the hot rolling are not particularly limited.

A sheet thickness of the hot-rolled steel sheet obtained by the hot rolling is not particularly specified. However, when the sheet thickness is less than 1.0 mm, sheet fracture may occur during sheet passing in the annealing process. When the sheet thickness is larger than 6.0 mm, the steel sheet is heavy, and even when tension is applied during sheet passing, the steel sheet is not taut and may meander. Therefore, the sheet thickness is preferably 1.0 to 6.0 mm.

[Coiling Process]

The steel sheet (hot-rolled steel sheet) hot-rolled as described above is cooled to a temperature (coiling temperature) of 400° C. or lower such that a cooling rate from a hot rolling process end temperature to the coiling temperature is always 5° C./s or faster, and is coiled at the temperature.

By setting the cooling rate (minimum cooling rate) to 5° C./s or faster and the coiling temperature to 400° C. or lower, ferritic transformation or pearlitic transformation is suppressed and a hard structure (low temperature transformation microstructure) that is a source of an acicular structure is obtained. The cooling rate is preferably 10° C./s or faster and more preferably 20° C./s or faster. An upper limit of the cooling rate is not particularly limited, but may be set to 100° C./s or slower from the viewpoint of manufacturability. At temperatures below 400° C., the cooling rate is not limited.

[Cold Rolling Process]

In the cold rolling process, the hot-rolled steel sheet after the coiling process is pickled and then subjected to cold rolling at a rolling reduction of 0.5% to 20.0% to obtain a cold-rolled steel sheet.

The pickling is a process for removing oxides on a surface of the hot-rolled steel sheet, and may be performed under known conditions. The number of times of pickling may be one or a plurality of times.

By applying strain by the cold rolling and increasing precipitation sites of carbides, precipitation of iron-based carbides in a heating stage of the annealing process described later is promoted. These iron-based carbides suppress movement of ferrite interfaces in the heating stage, so that acicular austenite can be obtained in a soaking stage. In order to obtain this effect, the rolling reduction of the cold rolling is set to 0.5% or more. The rolling reduction is preferably 5.0% or more.

On the other hand, in a case where the rolling reduction of the cold rolling exceeds 20.0%, the movement of the ferrite interfaces is promoted in the heating stage of the annealing process, and acicular austenite cannot be obtained. For this reason, the rolling reduction of the cold rolling is set to 20.0% or less. The rolling reduction of the cold rolling is preferably 18.0% or less.

[Hydrogen Content Reducing Process]

In the hydrogen content reducing process, the cold-rolled steel sheet is left in the air for a time t (unit: hour)=[−2.4×T+96] or longer from the cold rolling process to the annealing process described later (T is an average temperature (° C.) during left). According to this process, the amount of hydrogen that has infiltrated into the steel sheet in the heating or pickling process before the hot rolling can be reduced.

When t (leaving time) is shorter than −2.4×T+96 (hours), the amount of hydrogen cannot be sufficiently reduced.

However, in a case where T is 40° C. or higher, the leaving time is set to 1 hour or longer. That is, the leaving time is 1 hour or longer and t hours or longer.

[Annealing Process]

In the annealing process, the cold-rolled steel sheet after the hydrogen content reducing process is subjected to bending and bending back at 150° C. to 400° C., is then heated (heating stage) in an atmosphere containing 0.1 to 30.0 vol % of hydrogen and $H_2O$ and a remainder consisting of nitrogen and impurities and having a dew point of −20° C. to 20° C., is held (soaking stage) at an annealing holding temperature T° C. of Ac1° C. to Ac3° C. for 1 second or longer and 1000 seconds or shorter, is cooled (cooling stage) to a temperature range of 350° C. or higher and 480° C. or lower at an average cooling rate of 4° C./s or faster, and is held (holding stage) at the temperature range (350° C. or higher and 480° C. or lower) for 80 seconds or longer.

(Heating Stage)

In the heating stage of the annealing process, the steel sheet is subjected to bending and bending back with a roll having a radius of 1500 mm or less in a state where the temperature of the steel sheet is 150° C. to 400° C., and the steel sheet is heated in an atmosphere having a dew point of −20° C. to 20° C. and containing 0.1 to 30.0 vol % of hydrogen and a remainder consisting of nitrogen and impurities.

There are two effects by subjecting the steel sheet to bending and bending back at 150° C. to 400° C. One is that a sufficient amount of iron-based carbides can be precipitated. In this case, austenite has acicular shape in the soaking stage described later. The second is that by repeatedly applying compressive deformation and tensile deformation to the steel sheet, a lattice spacing inside the steel sheet can be repeatedly changed, and hydrogen in the surface layer can be discharged to an outside of the steel sheet. In addition, hydrogen present inside the steel sheet is also diffused to the surface layer side.

In the case of performing the bending and bending back, when the temperature is lower than 150° C., the diffusion of hydrogen does not sufficiently occur, so that a concentration of diffusible hydrogen in the finally obtained steel sheet becomes excessive. In addition, when the temperature exceeds 400° C., a rate at which dislocations applied by the bending and bending back is recovered is fast, so that a sufficient amount of iron-based carbides cannot be obtained and acicular austenite cannot be sufficiently obtained. When the radius of the roll exceeds 1500 mm, it is difficult to efficiently introduce dislocations into the microstructure of the steel sheet by the bending and bending back deformation. Therefore, the radius of the roll is set to 1500 mm or less.

In addition, by heating the steel sheet in an atmosphere containing 0.1 to 30.0 vol % of hydrogen and a remainder consisting of nitrogen and impurities and having a dew point of −20° C. to 20° C., diffusion of easily oxidizable elements into the surface of the steel sheet is prevented, and internal oxidation can be promoted.

When the amount of hydrogen is less than 0.1 vol %, an oxide film present on the surface of the steel sheet cannot be sufficiently reduced and the oxide film is formed on the steel sheet. Therefore, chemical convertibility and plating adhesion of the steel sheet obtained after heat treatments are reduced. In addition, when the amount of hydrogen exceeds 30.0 vol %, a risk of hydrogen explosion increases in operation. Therefore, the amount of hydrogen ($H_2$ content) in the atmosphere is set to 0.1 to 30.0 vol %.

In addition, when the dew point of the atmosphere is lower than −20° C., external oxidation of Si and Mn in the surface layer of the steel sheet occurs, and the internal oxidation and a decarbonizing reaction become insufficient. In this case, the LME resistance and the collision resistance decrease. In addition, when the dew point exceeds 20° C., an oxide film is formed on the steel sheet, the chemical convertibility and plating adhesion decrease, and the decarbonizing reaction proceeds excessively. Therefore, the strength of the steel sheet obtained after the annealing becomes insufficient.

Annealing furnaces are roughly divided into three regions: a preheating zone, a heating zone, and a soaking zone. In the present embodiment, an atmosphere in the heating zone is under the above-described conditions. Atmospheres in the preheating zone and the soaking zone can also be controlled.

(Soaking Stage)

In the soaking stage, the cold-rolled steel sheet after the heating stage is soaked in a temperature range of an Ac1 point to an Ac3 point for 1 second to 1000 seconds. By performing the soaking under such conditions, acicular austenite is formed along laths of tempered martensite.

A specific soaking temperature can be appropriately adjusted based on the Ac point (° C.) and the Ac3 point (° C.) represented by the following expressions in consideration of proportions of a desired metallographic structure.

$$Ac1=723-10.7\times Mn-16.9\times Ni+29.1\times Si+16.9\times Cr+290\times As+6.38\times W \quad (2)$$

$$Ac3=910-203\sqrt{C}+44.7\times Si-30\times Mn+700\times P-20\times Cu-15.2\times Ni-11\times Cr+31.5\times Mo+400\times Ti+104\times V+120\times Al \quad (3)$$

Here, C, Si, Mn, P, Cu, Ni, Cr, Mo, Ti, V, and Al are the amount [mass %] of each element.

When the soaking temperature is lower than the Ac1 point or a soaking time is shorter than 1 second, austenite is not generated during holding for soaking. Therefore, metallographic structure becomes a single phase microstructure of ferrite, and a target metallographic structure cannot be obtained. In addition, when the soaking temperature exceeds the Ac3 point, a microstructure during holding for soaking becomes a single phase microstructure of austenite, and a morphology of the hard structure (low temperature transformation microstructure) which is the source of the acicular structure disappears. Therefore, acicular austenite cannot be obtained. In addition, when the soaking time is longer than 1000 seconds, productivity decreases. The soaking time of the soaking stage may be set to 300 seconds or shorter from the viewpoint of suppressing coarsening of ferrite and austenite during the soaking.

The temperature of the steel sheet in the soaking stage does not need to be constant. As long as desired microstructure proportions can be obtained, the temperature of the steel sheet in the soaking stage may change within the temperature range of the Ac1 point to the Ac3 point.

(Cooling Stage)

In the cooling stage after the soaking stage, for a subsequent holding stage, the cold-rolled steel sheet after the soaking stage is cooled to a temperature range of 100° C. to 340° C. so that an average cooling rate becomes 4° C./s or faster. By performing the cooling under such conditions, ferritic transformation during the cooling can be suppressed, and a desired amount of martensite and residual austenite can be obtained in the final microstructure. When the average cooling rate is slower than 4° C./s, ferritic transformation cannot be suppressed.

When a cooling stop temperature is lower than 100° C., a martensite fraction increases. On the other hand, when the cooling stop temperature exceeds 340° C. ferrite, bainite, and pearlite fractions increase, and it becomes difficult to obtain a desired microstructure.

(Holding Stage)

In the holding stage, in order to reduce the amount of hydrogen in the steel sheet while increasing the stability of austenite, the cold-rolled steel sheet after the cooling stage is reheated to a temperature range of 350° C. to 480° C., and is held at the temperature range for 80 seconds or longer.

When a holding time is shorter than 80 seconds, carbon is not sufficiently concentrated in untransformed austenite, and hydrogen cannot be discharged to the outside of the steel sheet. By setting the holding time in the above temperature range to 80 seconds or longer, a carbon concentration in austenite can be increased, and a desired amount of residual austenite can be secured after final cooling. In order to stably obtain the above effects, the holding time is preferably set to 100 seconds or longer. It is not necessary to limit an upper limit of the holding time, but an excessively long holding time reduces productivity. Therefore, the holding time may be set to 1000 seconds or shorter.

In a case where the holding temperature is lower than 350° C., a desired amount of residual austenite cannot be obtained, and furthermore, sufficient diffusion of hydrogen does not occur. Therefore, the holding temperature is set to 350° C. or higher. The holding temperature is preferably 380° C. or higher. On the other hand, in a case where the holding temperature exceeds 480° C., residual austenite decomposes into ferrite and cementite, which is not preferable. Therefore, the holding temperature is set to 480° C. or lower. The holding temperature is preferably 450° C. or lower.

Conditions for cooling the cold-rolled steel sheet after the holding stage to room temperature are not limited. However, in order to stably obtain a desired metallographic structure, the cold-rolled steel sheet after the holding stage may be cooled so that an average cooling rate to an Ms point or lower becomes 2° C./s or faster.

In a case of reducing the amount of hydrogen in the steel sheet, as described above, it is important to control each stage of the hydrogen content reducing process, the bending and bending back in the annealing process, and the holding stage, and a sufficient effect cannot be obtained with only one of the stages.

(Plating Process)

The method for producing a steel sheet according to the present embodiment may further include a hot-dip galvanizing process of forming a plating on the surface of the cold-rolled steel sheet during the cooling stage after the annealing, during the holding stage, or after the holding stage. In addition, the method may further include an alloying process of alloying the plating layer after the hot-dip galvanizing process.

A hot-dip galvanizing method and an alloying method are not particularly limited, and a normal method can be used. As the hot-dip galvanizing method, for example, cooling is stopped in a temperature range of (molten zinc bath temperature−40°) C to (molten zinc bath temperature+50°) C during the cooling stage, and the steel sheet is controlled to this temperature range and is immersed in a hot-dip galvanizing bath to form a hot-dip galvanized plating. In addition, examples of the alloying method include a method of alloying the hot-dip galvanized plating in a temperature range of 300° C. to 500° C.

Examples

The present invention will be described more specifically with reference to examples.

Slabs having the chemical composition shown in Table 1 were cast. The slabs after the casting were heated to the temperature shown in Table 2 and were then subjected to hot rolling to a thickness of 1.0 to 6.0 mm. After the hot rolling, the hot-rolled steel sheets were cooled and coiled under the conditions shown in Table 2, and were then subjected to cold rolling under the conditions shown in Table 2 to obtain cold-rolled steel sheets.

These cold-rolled steel sheets were left in the air under the conditions shown in Table 3 to reduce the amount of hydrogen. Thereafter, annealing was performed under the conditions shown in Tables 3 and 4. In examples in which bending and bending back was performed, bending and bending back was performed with a roll having a radius of a roll diameter of 1100 mm in a temperature range of 150° C. to 400° C. In addition, after a holding stage, cooling was performed so that an average cooling rate to a Ms point or lower became 2° C./s or faster.

In addition, thereafter, in some examples, the cold-rolled steel sheet was controlled in a temperature range of (molten zinc bath temperature−40°) C to (molten zinc bath temperature+50°) C and was then immersed in a hot-dip galvanizing bath to perform a plating. Furthermore, in some examples in which the plating was performed, the steel sheet was heated to a temperature range of 300° C. to 500° C. to alloy a plating layer.

In the tables, GI is an example in which hot-dip galvanizing was performed, and GA is an example in which hot-dip galvannealing was performed.

Accordingly, the steel sheets of Example Nos. 1 to 37 were obtained.

TABLE 1

| Kind of steel | C | Si | Al | Mn | P | S | N | O | Others | Ac1 point (° C.) | Ac3 point (° C.) |
|---|---|---|---|---|---|---|---|---|---|---|---|
| | mass %, remainder is Fe and impurities | | | | | | | | | | |
| A | 0.20 | 0.40 | 0.80 | 2.5 | 0.0090 | 0.0017 | 0.0023 | 0.0018 | | 708 | 864 |
| B | 0.11 | 0.79 | 0.54 | 2.4 | 0.0170 | 0.0009 | 0.0019 | 0.0024 | Cr: 0.13 | 723 | 881 |
| C | 0.39 | 1.10 | 1.10 | 3.8 | 0.0042 | 0.0069 | 0.0013 | 0.0015 | Ni: 0.35, Cu: 0.09, B: 0.0015 | 708 | 847 |
| D | 0.32 | 0.12 | 1.30 | 1.3 | 0.0048 | 0.0018 | 0.0023 | 0.0020 | Ti: 0.030, Mo: 0.20 | 713 | 939 |
| E | 0.14 | 1.10 | 0.83 | 2.2 | 0.0140 | 0.0017 | 0.0044 | 0.0015 | Nb: 0.08 | 731 | 926 |
| F | 0.13 | 0.75 | 0.40 | 3.7 | 0.0016 | 0.0022 | 0.0016 | 0.0023 | V: 0.11 | 705 | 820 |
| G | 0.13 | 0.65 | 0.42 | 1.1 | 0.0100 | 0.0043 | 0.0030 | 0.0023 | Sb: 0.045 | 730 | 890 |
| H | 0.17 | 0.95 | 0.48 | 1.5 | 0.0089 | 0.0149 | 0.0014 | 0.0009 | Co: 0.05 | 735 | 888 |
| I | 0.12 | 0.16 | 0.90 | 3.1 | 0.0026 | 0.0022 | 0.0168 | 0.0042 | Ca: 0.0018 | 694 | 864 |
| J | 0.15 | 0.69 | 0.57 | 2.8 | 0.0016 | 0.0034 | 0.0020 | 0.0018 | La: 0.0016 | 713 | 848 |
| K | 0.26 | 0.98 | 1.40 | 1.6 | 0.0023 | 0.0009 | 0.0075 | 0.0034 | Zr: 0.003, As: 0.003 | 735 | 972 |
| L | 0.18 | 0.30 | 1.04 | 1.9 | 0.0020 | 0.0015 | 0.0021 | 0.0114 | Mg: 0.004 | 711 | 906 |
| M | 0.15 | 0.50 | 0.59 | 1.8 | 0.0075 | 0.0026 | 0.0024 | 0.0012 | Ce: 0.002 | 718 | 875 |
| N | 0.23 | 0.42 | 1.20 | 3.5 | 0.0031 | 0.0017 | 0.0013 | 0.0174 | W: 0.03, Sn: 0.02 | 698 | 873 |
| O | 0.16 | 0.28 | 0.76 | 2.0 | 0.0029 | 0.0025 | 0.0017 | 0.0075 | Y: 0.004 | 710 | 874 |
| P | 0.20 | 0.53 | 0.69 | 3.2 | 0.0005 | 0.0036 | 0.0008 | 0.0013 | Ta: 0.005 | 704 | 830 |
| Q | 0.09 | 0.87 | 1.30 | 2.0 | 0.0067 | 0.0022 | 0.0020 | 0.0045 | | 727 | 989 |
| R | 0.41 | 1.13 | 0.99 | 2.6 | 0.0045 | 0.0037 | 0.0017 | 0.0036 | | 728 | 874 |
| S | 0.24 | 0.08 | 0.41 | 2.8 | 0.0063 | 0.0047 | 0.0020 | 0.0020 | | 695 | 784 |
| T | 0.31 | 1.23 | 0.94 | 1.3 | 0.0050 | 0.0014 | 0.0013 | 0.0014 | | 745 | 929 |
| U | 0.13 | 0.40 | 0.20 | 1.6 | 0.0058 | 0.0046 | 0.0015 | 0.0026 | | 718 | 835 |
| V | 0.13 | 0.75 | 1.05 | 0.9 | 0.0094 | 0.0091 | 0.0026 | 0.0017 | | 735 | 976 |

TABLE 2

| Example No. | Kind of steel | Hot rolling process Heating temperature before hot rolling (° C.) | Coiling process Minimum cooling rate (° C./s) | Coiling process Coiling temperature (° C.) | Cold rolling process Cold rolling ratio (%) |
|---|---|---|---|---|---|
| 1 | A | 1200 | 23 | 350 | 16.0 |
| 2 | B | 1200 | 18 | 224 | 11.0 |
| 3 | C | 1200 | 10 | 295 | 7.0 |
| 4 | D | 1200 | 16 | 315 | 3.0 |
| 5 | E | 1200 | 15 | 60 | 17.0 |
| 6 | F | 1250 | 32 | 206 | 19.0 |
| 7 | G | 1250 | 25 | 16 | 4.0 |
| 8 | H | 1250 | 8 | 71 | 19.0 |
| 9 | I | 1250 | 20 | 255 | 16.0 |
| 10 | J | 1200 | 18 | 107 | 7.0 |
| 11 | K | 1250 | 37 | 122 | 1.0 |
| 12 | L | 1200 | 11 | 283 | 15.0 |
| 13 | M | 1200 | 12 | 168 | 6.0 |
| 14 | N | 1200 | 7 | 358 | 13.0 |
| 15 | O | 1250 | 40 | 341 | 9.0 |
| 16 | P | 1250 | 52 | 179 | 14.0 |
| 17 | A | 1250 | 4 | 158 | 12.0 |
| 18 | A | 1250 | 66 | 410 | 10.0 |
| 19 | A | 1200 | 11 | 165 | 0.0 |
| 20 | A | 1200 | 37 | 43 | 21.0 |

TABLE 2-continued

| Example No. | Kind of steel | Hot rolling process Heating temperature before hot rolling (° C.) | Coiling process Minimum cooling rate (° C./s) | Coiling process Coiling temperature (° C.) | Cold rolling process Cold rolling ratio (%) |
|---|---|---|---|---|---|
| 21 | A | 1200 | 29 | 223 | 10.0 |
| 22 | A | 1250 | 13 | 270 | 3.0 |
| 23 | A | 1250 | 31 | 220 | 13.0 |
| 24 | A | 1250 | 43 | 138 | 6.0 |
| 25 | A | 1250 | 19 | 321 | 11.0 |
| 26 | A | 1250 | 11 | 360 | 2.0 |
| 27 | A | 1250 | 22 | 163 | 15.0 |
| 28 | A | 1250 | 12 | 62 | 4.0 |
| 29 | A | 1250 | 14 | 101 | 18.0 |
| 30 | A | 1200 | 13 | 326 | 11.0 |
| 31 | Q | 1200 | 20 | 376 | 2.0 |
| 32 | R | 1200 | 25 | 243 | 6.0 |
| 33 | S | 1200 | 13 | 85 | 18.0 |
| 34 | T | 1200 | 14 | 248 | 14.0 |
| 35 | U | 1250 | 30 | 354 | 12.0 |
| 36 | V | 1250 | 14 | 235 | 16.0 |
| 37 | A | 1250 | 21 | 173 | 0.0 |

TABLE 3

| Example No. | Hydrogen reduction process: Average temperature (° C.) | Hydrogen reduction process: −2.4 × (average temperature during left) + 96 | Hydrogen reduction process: Leaving time in air (hour) | Annealing Heating stage: Presence or absence of bending and bending back | Annealing Heating stage: Hydrogen concentration in atmosphere (vol %) | Annealing Heating stage: Dew point (° C.) |
|---|---|---|---|---|---|---|
| 1 | 17 | 55 | 121 | Present | 7.0 | 5 |
| 2 | 17 | 55 | 141 | Present | 0.5 | −10 |
| 3 | 17 | 55 | 201 | Present | 0.9 | 4 |
| 4 | 17 | 55 | 62 | Present | 17.5 | 15 |
| 5 | 29 | 26 | 93 | Present | 4.0 | 13 |
| 6 | 29 | 26 | 113 | Present | 5.7 | 19 |
| 7 | 29 | 26 | 219 | Present | 2.0 | −17 |
| 8 | 29 | 26 | 110 | Present | 0.2 | −13 |
| 9 | 7 | 79 | 107 | Present | 22.5 | 16 |
| 10 | 7 | 79 | 141 | Present | 2.1 | 16 |
| 11 | 7 | 79 | 126 | Present | 0.5 | −15 |
| 12 | 17 | 55 | 85 | Present | 9.7 | 13 |
| 13 | 17 | 55 | 96 | Present | 0.7 | −16 |
| 14 | 17 | 55 | 83 | Present | 1.5 | −11 |
| 15 | 17 | 55 | 122 | Present | 3.7 | 0 |
| 16 | 17 | 55 | 104 | Present | 5.5 | −3 |
| 17 | 21 | 46 | 112 | Present | 21.5 | 19 |
| 18 | 21 | 46 | 116 | Present | 2.3 | 14 |
| 19 | 21 | 46 | 93 | Present | 3.0 | −7 |
| 20 | 21 | 46 | 460 | Present | 1.8 | 5 |
| 21 | 18 | 53 | 46 | Present | 4.8 | 0 |
| 22 | 18 | 53 | 79 | Absent | 9.4 | 3 |
| 23 | 20 | 48 | 111 | Present | 18.5 | −22 |
| 24 | 20 | 48 | 108 | Present | 1.5 | 21 |
| 25 | 20 | 48 | 106 | Present | 9.9 | 7 |
| 26 | 20 | 48 | 95 | Present | 7.3 | 10 |
| 27 | 20 | 48 | 90 | Present | 10.7 | 15 |
| 28 | 20 | 48 | 114 | Present | 1.2 | −19 |
| 29 | 20 | 48 | 73 | Present | 1.0 | 0 |
| 30 | 20 | 48 | 105 | Present | 12.7 | 18 |
| 31 | 17 | 55 | 141 | Present | 2.6 | −11 |
| 32 | 17 | 55 | 120 | Present | 5.1 | −5 |
| 33 | 17 | 55 | 117 | Present | 1.4 | −15 |
| 34 | 17 | 55 | 107 | Present | 2.8 | −11 |
| 35 | 17 | 55 | 64 | Present | 7.0 | 7 |
| 36 | 17 | 55 | 88 | Present | 6.1 | 9 |
| 37 | | Not performed | | Absent | 10.0 | 14 |

TABLE 4

| Example No. | Annealing process: Soaking stage: Holding temperature (° C.) | Soaking stage: Holding time (second) | Cooling stage: Average cooling rate (° C./s) | Cooling stage: Cooling stop temperature (° C.) | Holding stage: Holding temperature (° C.) | Holding stage: Holding time (second) | Plating process: Presence or absence of plating |
|---|---|---|---|---|---|---|---|
| 1 | 822 | 60 | 25 | 250 | 400 | 361 | GA |
| 2 | 842 | 60 | 12 | 264 | 400 | 175 | |
| 3 | 814 | 60 | 41 | 100 | 400 | 396 | |
| 4 | 871 | 60 | 24 | 212 | 400 | 243 | |
| 5 | 864 | 60 | 30 | 240 | 420 | 320 | GA |
| 6 | 783 | 60 | 11 | 179 | 420 | 127 | |
| 7 | 854 | 60 | 31 | 310 | 400 | 232 | |
| 8 | 850 | 100 | 16 | 290 | 440 | 256 | GA |
| 9 | 821 | 100 | 31 | 230 | 400 | 144 | |
| 10 | 805 | 100 | 34 | 215 | 380 | 297 | GI |
| 11 | 894 | 100 | 11 | 200 | 370 | 185 | |
| 12 | 851 | 80 | 22 | 249 | 400 | 139 | GA |
| 13 | 828 | 80 | 6 | 250 | 400 | 127 | |
| 14 | 822 | 80 | 34 | 150 | 400 | 268 | GI |
| 15 | 827 | 50 | 19 | 240 | 400 | 210 | |
| 16 | 790 | 50 | 23 | 140 | 400 | 152 | |
| 17 | 819 | 60 | 37 | 210 | 400 | 609 | |
| 18 | 814 | 60 | 26 | 210 | 400 | 240 | |
| 19 | 817 | 60 | 7 | 210 | 400 | 159 | |

TABLE 4-continued

| | Annealing process | | | | | | Plating |
|---|---|---|---|---|---|---|---|
| | Soaking stage | | Cooling stage | | Holding stage | | process |
| Example No. | Holding temperature (° C.) | Holding time (second) | Average cooling rate (° C./s) | Cooling stop temperature (° C.) | Holding temperature (° C.) | Holding time (second) | Presence or absence of plating |
| 20 | 816 | 60 | 27 | 210 | 400 | 191 | |
| 21 | 819 | 60 | 21 | 210 | 400 | 158 | GA |
| 22 | 814 | 60 | 15 | 210 | 400 | 172 | |
| 23 | 817 | 60 | 33 | 210 | 400 | 202 | |
| 24 | 816 | 60 | 28 | 210 | 400 | 145 | |
| 25 | 705 | 60 | 39 | 210 | 400 | 583 | GI |
| 26 | 874 | 60 | 26 | 100 | 400 | 244 | |
| 27 | 819 | 60 | 3 | 250 | 400 | 197 | |
| 28 | 833 | 60 | 14 | 200 | 340 | 373 | |
| 29 | 830 | 60 | 12 | 260 | 490 | 190 | |
| 30 | 819 | 60 | 24 | 216 | 400 | 75 | |
| 31 | 913 | 60 | 30 | 250 | 400 | 205 | |
| 32 | 825 | 60 | 11 | 102 | 400 | 172 | |
| 33 | 755 | 60 | 31 | 170 | 400 | 182 | GA |
| 34 | 896 | 60 | 16 | 235 | 400 | 314 | |
| 35 | 804 | 60 | 25 | 250 | 400 | 360 | GI |
| 36 | 880 | 60 | 25 | 300 | 400 | 210 | |
| 37 | 842 | 100 | 17 | 250 | 400 | 157 | |

<Measurement of Metallographic Structure>

A test piece for SEM observation was collected from the obtained steel sheet (the steel sheet after the annealing or the steel sheet plated after the annealing), a longitudinal section parallel to a rolling direction was polished, a metallographic structure at a ¼ thickness position was observed according to the above-described manner, an area ratio of each microstructure (ferrite, bainite, pearlite, and a remainder (fresh martensite and/or tempered martensite) was measured by image processing, and this was taken as a volume percentage. In addition, X-ray diffraction was performed in the above-described manner to obtain a volume percentage of residual austenite. The volume percentage of each microstructure is shown in Table 5.

In addition, from the obtained steel sheet, an area ratio of residual austenite having an aspect ratio of 3.0 or more in total residual austenite was obtained by an EBSD analysis method using FE-SEM in the above-described manner. The results are shown in Table 5.

In addition, from the obtained steel sheet, a thickness of a decarburized layer and a thickness of an internal oxide layer were measured in the above-described manner. In addition, the amount of diffusible hydrogen contained in steel was measured in the above-described manner. The results are shown in Table 5.

TABLE 5

| | | Metallographic structure | | | | | | |
|---|---|---|---|---|---|---|---|---|
| Example No. | Kind of steel | Total volume percentage of ferrite, bainite, and pearlite (%) | Volume percentage of residual austenite (%) | Volume percentage of remainder in microstructure (%) | Proportion of residual austenite having aspect ratio of 3.0 or more (area %) | Thickness of internal oxide layer (μm) | Thickness of decarburized layer (μm) | Amount of diffusible hydrogen contained in steel (ppm) |
| 1 | A | 49 | 12 | 39 | 88 | 5.4 | 25 | 0.86 |
| 2 | B | 42 | 5 | 53 | 92 | 6.9 | 44 | 0.75 |
| 3 | C | 44 | 20 | 36 | 91 | 7.5 | 53 | 0.70 |
| 4 | D | 46 | 9 | 45 | 85 | 4.5 | 15 | 0.91 |
| 5 | E | 49 | 4 | 47 | 94 | 6.7 | 45 | 0.62 |
| 6 | F | 49 | 7 | 44 | 80 | 5.7 | 30 | 0.79 |
| 7 | G | 37 | 5 | 58 | 93 | 4.4 | 12 | 0.39 |
| 8 | H | 42 | 8 | 50 | 87 | 8.1 | 59 | 0.60 |
| 9 | I | 43 | 4 | 53 | 88 | 4.5 | 14 | 0.86 |
| 10 | J | 49 | 7 | 44 | 92 | 8.3 | 58 | 0.80 |
| 11 | K | 49 | 5 | 46 | 86 | 6.4 | 37 | 0.95 |
| 12 | L | 45 | 4 | 51 | 91 | 8.2 | 54 | 0.79 |
| 13 | M | 44 | 4 | 52 | 92 | 6.3 | 33 | 0.84 |
| 14 | N | 48 | 7 | 45 | 85 | 5.4 | 22 | 0.90 |
| 15 | O | 43 | 4 | 53 | 84 | 5.4 | 22 | 0.86 |
| 16 | P | 45 | 5 | 50 | 92 | 4.4 | 15 | 0.78 |
| 17 | A | 45 | 7 | 48 | 61 | 4.9 | 19 | 1.05 |
| 18 | A | 49 | 8 | 43 | 54 | 7.7 | 50 | 1.10 |

TABLE 5-continued

| Example No. | Kind of steel | Metallographic structure: Total volume percentage of ferrite, bainite, and pearlite (%) | Volume percentage of residual austenite (%) | Volume percentage of remainder in microstructure (%) | Proportion of residual austenite having aspect ratio of 3.0 or more (area %) | Thickness of internal oxide layer (μm) | Thickness of decarburized layer (μm) | Amount of diffusible hydrogen contained in steel (ppm) |
|---|---|---|---|---|---|---|---|---|
| 19 | A | 47 | 7 | 46 | 67 | 7.2 | 42 | 1.12 |
| 20 | A | 48 | 8 | 44 | 51 | 7.2 | 42 | 1.18 |
| 21 | A | 45 | 7 | 48 | 87 | 4.9 | 20 | 1.03 |
| 22 | A | 49 | 8 | 43 | 68 | 4.5 | 13 | 1.20 |
| 23 | A | 47 | 7 | 46 | 89 | 2.3 | 7 | 0.81 |
| 24 | A | 48 | 8 | 45 | 88 | 9.1 | 112 | 0.84 |
| 25 | A | 100 | 0 | 0 | 86 | 4.5 | 15 | 0.81 |
| 26 | A | 4 | 1 | 95 | 36 | 5.4 | 22 | 1.23 |
| 27 | A | 57 | 9 | 34 | 87 | 5.4 | 22 | 0.83 |
| 28 | A | 39 | 1 | 60 | 91 | 4.9 | 20 | 0.82 |
| 29 | A | 56 | 2 | 42 | 87 | 8.1 | 53 | 0.85 |
| 30 | A | 46 | 1 | 53 | 84 | 5.4 | 25 | 0.96 |
| 31 | Q | 43 | 1 | 56 | 81 | 4.4 | 14 | 0.90 |
| 32 | R | 50 | 24 | 26 | 89 | 4.4 | 12 | 0.81 |
| 33 | S | 46 | 1 | 53 | 87 | 5.0 | 19 | 0.79 |
| 34 | T | 35 | 10 | 55 | 89 | 4.4 | 15 | 0.83 |
| 35 | U | 36 | 2 | 62 | 85 | 4.9 | 20 | 0.91 |
| 36 | V | 66 | 4 | 30 | 88 | 5.7 | 30 | 0.84 |
| 37 | A | 34 | 9 | 57 | 72 | 5.4 | 25 | 1.21 |

<Measurement of Characteristics>

In addition, tensile strength (TS), uniform elongation (u-El) as an index of formability, collision resistance assuming after punching, and LME resistance of a spot-welding portion of the obtained steel sheet were evaluated by the following methods.

(Tensile Strength)

(Uniform Elongation)

A JIS No. 5 tensile test piece described in JIS Z 2241:2011 was collected from the obtained steel sheet in a direction perpendicular to the rolling direction, and a tensile test was performed in accordance with JIS Z 2241:2011 to measure tensile strength and uniform elongation.

A case where the tensile strength was 980 MPa or more was regarded as acceptable.

In addition, in a case where the uniform elongation (%) was 7.0% or more, it was determined that the formability was excellent.

The measurement results of the tensile strength are shown in Table 6.

(Collision Resistance)

The collision resistance was evaluated by a range of values of R represented by the following expression.

It was assumed that a tensile strength when a semi-circular punched hole having a diameter of 10 mm was formed in central parts of both ends of the JIS No. 5 tensile test piece under conditions of a punch diameter of 10 mm and a punching clearance of 12±2% and was pulled in accordance with JIS Z 2241:2011 was TS1, a tensile strength when a semi-circular reamed hole having a diameter of 10 mm was formed in central parts of both ends of the JIS No. 5 tensile test piece by machining and was pulled in accordance with JIS Z 2241:2011 was TS2, and R=TS1/TS2 was established.

Evaluation was performed as follows according to R (=TS1/TS2), and in a case of A or B, excellent collision resistance was determined.

A: R=0.96 to 1.00

B: R=0.93 to less than 0.96

C: R=less than 0.93

(LME Resistance)

A 50 mm×80 mm test piece was collected from the obtained steel sheet.

In addition, a slab having the chemical composition of A in Table 1 was cast, and after applying production conditions of Example No. 1, the steel sheet was immersed in a hot-dip galvanizing bath to produce a hot-dip galvanized steel sheet (opposite material). A test piece having a size of 50 mm×80 mm was collected from the produced steel sheet (opposite material).

The steel sheet as the opposite material was overlapped on the test piece collected from each of the steel sheets of Example Nos. 1 to 37, and the two steel sheets were spot-welded as shown in FIG. 1. Specifically, the hot-dip galvanized steel sheet as the opposite material was used as a steel sheet 1*d* in FIG. 1, the steel sheet (Example Nos. 1 to 37) to be evaluated was used as a steel sheet 1*e*, and the two sheets were overlapped and spot-welded with a pair of electrodes 4*a* and 4*b*. As welding conditions, a servomotor pressure type single-phase AC spot welder (power supply frequency 50 Hz) was used, and welding was performed with a current value of 6.5 kA, an electrode inclination angle θ of 3°, no upslope, an energization time of 0.4 seconds, and a hold time of 0.1 seconds after the end of energization while pressing the sheets against each other at a pressure of 450 kgf (4413 kg·m/s$^2$).

After the spot welding, microstructures of a nugget central part of a joint portion of the steel sheets were observed using an optical microscope at a magnification of 200 to 1000-fold. As a result of the observation, a case where no crack had occurred was evaluated as "A", a case where a crack having a length of less than 100 μm was observed was evaluated as "B", and a case where a crack having a length of 100 μm or more was observed was evaluated as "C". In a case of being evaluated as A or B, excellent LME resistance was determined.

TABLE 6

| Example No. | Kind of steel | Tensile strength TS (MPa) | Uniform elongation u-El (%) | Collision resistance R | LME resistance | Note |
|---|---|---|---|---|---|---|
| 1 | A | 1040 | 15.0 | A | A | Invention Example |
| 2 | B | 995 | 13.4 | A | A | Invention Example |
| 3 | C | 1294 | 16.6 | A | B | Invention Example |
| 4 | D | 1038 | 13.4 | A | A | Invention Example |
| 5 | E | 985 | 14.6 | A | B | Invention Example |
| 6 | F | 1003 | 11.0 | A | A | Invention Example |
| 7 | G | 989 | 14.0 | A | A | Invention Example |
| 8 | H | 1003 | 14.0 | A | A | Invention Example |
| 9 | I | 981 | 11.8 | A | A | Invention Example |
| 10 | J | 987 | 14.4 | A | A | Invention Example |
| 11 | K | 1045 | 13.0 | A | A | Invention Example |
| 12 | L | 987 | 13.3 | A | A | Invention Example |
| 13 | M | 998 | 13.2 | A | A | Invention Example |
| 14 | N | 1017 | 12.4 | A | A | Invention Example |
| 15 | O | 992 | 11.2 | A | A | Invention Example |
| 16 | P | 1025 | 12.9 | A | A | Invention Example |
| 17 | A | 994 | 6.8 | C | A | Comparative Example |
| 18 | A | 993 | 6.7 | C | A | Comparative Example |
| 19 | A | 986 | 6.9 | C | A | Comparative Example |
| 20 | A | 992 | 6.1 | C | A | Comparative Example |
| 21 | A | 994 | 12.9 | C | A | Comparative Example |
| 22 | A | 1015 | 6.9 | C | A | Comparative Example |
| 23 | A | 986 | 13.5 | B | C | Comparative Example |
| 24 | A | 943 | 13.5 | A | A | Comparative Example |
| 25 | A | 428 | 20.4 | A | A | Comparative Example |
| 26 | A | 1300 | 6.9 | C | A | Comparative Example |
| 27 | A | 881 | 15.0 | A | A | Comparative Example |
| 28 | A | 1065 | 6.8 | C | A | Comparative Example |
| 29 | A | 875 | 11.3 | A | A | Comparative Example |
| 30 | A | 989 | 6.2 | C | A | Comparative Example |
| 31 | Q | 952 | 6.5 | A | B | Comparative Example |
| 32 | R | 1163 | 15.2 | A | C | Comparative Example |
| 33 | S | 1045 | 6.7 | A | A | Comparative Example |
| 34 | T | 1186 | 14.1 | A | C | Comparative Example |
| 35 | U | 982 | 6.8 | A | A | Comparative Example |
| 36 | V | 731 | 16.7 | A | A | Comparative Example |
| 37 | A | 992 | 6.8 | G | A | Comparative Example |

As shown in Tables 1 to 6, in examples (Example Nos. 1 to 16) according to the present invention, the tensile strength was a value larger than 980 MPa, the uniform elongation was a value larger than 7.0%. R as the index of the collision resistance was evaluated as A or B, and the LME resistance (the length of a crack after spot welding) was evaluated as A or B.

In addition, regarding the steel sheets, also in plated steel sheets subjected to the hot-dip galvanizing or the hot-dip galvanizing and the alloying, the tensile strength was a value higher than 980 MPa, the uniform elongation was a value larger than 7.0%, R as the index of the collision resistance was evaluated as A or B. and the length of a crack after spot welding was evaluated as A or B.

On the other hand, in Example Nos. 17 to 37, which are comparative examples, any one of the chemical composition and the microstructures was outside of the ranges of the present invention, and any one of tensile strength, uniform elongation, collision resistance, and LME resistance was inferior.

In Example No. 17, a minimum cooling rate from a hot rolling process end temperature to a coiling temperature was slower than 5° C./s. Therefore, in the microstructure after the annealing, a proportion of residual austenite having an aspect ratio of 3.0 or more was small, and the amount of diffusible hydrogen contained in steel was large. As a result, the uniform elongation and the collision resistance were low.

In Example No. 18, the coiling temperature was higher than 400° C. Therefore, the proportion of residual austenite having an aspect ratio of 3.0 or more was small, and the amount of diffusible hydrogen contained in steel was large. As a result, the uniform elongation and the collision resistance were low.

In Example No. 19, since a cold rolling reduction ratio was less than 0.5% in the cold rolling process, the proportion of residual austenite having an aspect ratio of 3.0 or more in the microstructure after the annealing was small, and the amount of diffusible hydrogen contained in steel was large. As a result, the uniform elongation and the collision resistance were low.

In Example No. 20, since the cold rolling reduction ratio was more than 20.0% in the cold rolling process, the proportion of residual austenite having an aspect ratio of 3.0 or more in the microstructure after the annealing was small, and the amount of diffusible hydrogen contained in steel was large. As a result, the uniform elongation and the collision resistance were low.

In Example No. 21, since a leaving time in the air in the hydrogen content reducing process was shorter than $-2.4\times T+96$ (hour), the amount of diffusible hydrogen could not be sufficiently reduced. As a result, the collision resistance was low.

In Example No. 22, since bending and bending back was not applied in the heating stage of the annealing process, the proportion of residual austenite having an aspect ratio of 3.0 or more in the microstructure after the annealing was small, and the amount of diffusible hydrogen contained in steel was large. As a result, the uniform elongation and the collision resistance were low.

In Example No. 23, since a dew point was lower than −20° C. in the heating stage of the annealing process, the thickness of the internal oxide layer and the thickness of the decarburized layer could not be sufficiently obtained. As a result, the LME resistance was low.

In Example No. 24, since the dew point exceeded 20° C. in the heating stage of the annealing process, the thickness of the decarburized layer became excessive. As a result, the tensile strength was low.

In Example No. 25, since a holding temperature was lower than the Ac1 point in the soaking stage of the annealing process, the total area ratio of ferrite, bainite, and pearlite exceeded 50%, and the volume percentage of residual austenite was 0%. As a result, the tensile strength was low.

In Example No. 26, since the holding temperature exceeded the Ac3 point in the soaking stage of the annealing process, the volume percentage of residual austenite was reduced, and the proportion of residual austenite having an aspect ratio of 3.0 or more was also reduced. As a result, the collision resistance and the uniform elongation were low.

In Example No. 27, since the average cooling rate was slower than 4° C./s in the cooling stage of the annealing process, the total area ratio of ferrite, bainite, and pearlite exceeded 50%. As a result, the tensile strength was low.

In Example No. 28, since the holding temperature was lower than 350° C. in the holding stage of the annealing process, residual austenite was not stabilized, and the volume percentage of residual austenite was reduced. As a result, the uniform elongation was low.

In Example No. 29, since the holding temperature exceeded 480° C. in the holding stage of the annealing process, the total area ratio of ferrite, bainite, and pearlite exceeded 50%. As a result, the tensile strength was low.

In Example No. 30, since a holding time was shorter than 80 seconds in the holding stage of the annealing process, residual austenite was not stabilized, and the volume percentage of the residual austenite was reduced. As a result, the uniform elongation was low.

In Example No. 31, since a C content was less than 0.10%, the tensile strength was low. In addition, the volume percentage of residual austenite was insufficient. As a result, the uniform elongation was low.

In Example No. 32, since the C content exceeded 0.40%, the LME resistance decreased.

In Example No. 33, since a Si content was less than 0.10%, the volume percentage of residual austenite was insufficient. As a result, the uniform elongation was low.

In Example No. 34, since the Si content exceeded 1.20%, the LME resistance decreased.

In Example No. 35, since an Al content was less than 0.30%, the volume percentage of residual austenite was insufficient. As a result, the uniform elongation was low.

In Example No. 36, since a Mn content was less than 1.0%, the total area ratio of ferrite, bainite, and pearlite exceeded 50%. As a result, the tensile strength was low.

In Example No. 37, since the cold rolling ratio in the cold rolling process was less than 0.5% and the hydrogen content reducing process was not performed, the proportion of residual austenite having an aspect ratio of 3.0 or more was small in the microstructure after the annealing, and the amount of diffusible hydrogen contained in steel was large. As a result, the uniform elongation and the collision resistance were low.

BRIEF DESCRIPTION OF THE REFERENCE SYMBOLS

1*d*, 1*e*: steel sheet
4*a*, 4*b*: electrode

What is claimed is:

1. A steel sheet comprising, as a chemical composition, by mass %:

C: 0.10% to 0.40%;
Si: 0.10% to 1.20%;
Al: 0.30% to 1.50%;
Mn: 1.0% to 4.0%;
P: 0.0200% or less;
S: 0.0200% or less;
N: 0.0200% or less;
O: 0.0200% or less;
Ni: 0% to 1.00%;
Mo: 0% to 0.50%;
Cr: 0% to 2.00%;
Ti: 0% to 0.100%;
B: 0% to 0.0100%;
Nb: 0% to 0.10%;
V: 0% to 0.50%;
Cu: 0% to 0.50%;
W: 0% to 0.10%;
Ta: 0% to 0.100%;
Co: 0% to 0.50%;
Mg: 0% to 0.050%;
Ca: 0% to 0.0500%;
Y: 0% to 0.050%;
Zr: 0% to 0.050%;
La: 0% to 0.0500%;
Ce: 0% to 0.050%;
Sn: 0% to 0.05%;
Sb: 0% to 0.050%;
As: 0% to 0.050%; and
a remainder of Fe and impurities, wherein the steel sheet includes, as a metallographic structure, ferrite, bainite, and pearlite in a total volume percentage of 0% or more and 50% or less, residual austenite in a volume percentage of 3% or more and 20% or less, and a remainder of one or two of fresh martensite and tempered martensite, residual austenite having an aspect ratio of 3.0 or more occupies 80% or more of a total residual austenite by area ratio, the steel sheet includes an internal oxide layer that is present from a surface of the steel sheet to a depth of at least 4.0 μm and a decarburized layer that is present from a surface of the steel sheet to a depth of 10 μm or more and 100 μm or less, and an amount of diffusible hydrogen included in the steel sheet is 1.00 ppm or less on a mass basis.

2. The steel sheet according to claim 1, further comprising:

a hot-dip galvanized layer on the surface.

3. The steel sheet according to claim 1, further comprising:

a hot-dip galvannealed layer on the surface.

4. A method for producing a steel sheet comprising:

a hot rolling process of performing hot rolling on a slab having the chemical composition according to claim 1 to obtain a hot-rolled steel sheet;

a coiling process of cooling the hot-rolled steel sheet at a cooling rate of 5° C./s or faster and coiling the hot-rolled steel sheet at 400° C. or lower;

a cold rolling process of pickling the hot-rolled steel sheet after the coiling and performing cold rolling on the hot-rolled steel sheet at a rolling reduction of 0.5% or more and 20.0% or less to obtain a cold-rolled steel sheet;

a hydrogen content reducing process of leaving the cold-rolled steel sheet in air for a time of 1 hour or longer when T is 40° C. or higher, and when T is less than 40° C. leaving the cold-rolled steel sheet in air for a time t represented by Expression (1) or longer:

$$t=-2.4\times T+96 \quad (1)$$

where T is an average temperature (C) during the time when the cold-rolled steel sheet is left in the air; and an annealing process of annealing the cold-rolled steel sheet after the hydrogen content reducing process, wherein the annealing process includes subjecting the cold-rolled steel sheet to bending and bending back at 150° C. to 400° C., heating the cold-rolled steel sheet in an atmosphere having a dew point of −20° C. to 20° C., and containing 0.1 to 30.0 vol % of hydrogen and a remainder comprising nitrogen and impurities, holding the cold-rolled steel sheet after the heating at a holding temperature of Ac1° C. to Ac3° C. for 1 second or longer and 1000 seconds or shorter, cooling the cold-rolled steel sheet after the holding to 100° C. to 340° C. at an average cooling rate of 4° C./s or faster, and reheating the cold-rolled steel sheet after the cooling and holding the cold-rolled steel sheet at 350° C. or higher and 480° C. or lower for 80 seconds or longer.

5. The method for producing a steel sheet according to claim 4, further comprising:

controlling the cold-rolled steel sheet after the annealing to a temperature range of (molten zinc bath temperature−40)° C. to (molten zinc bath temperature+50° C.) and immersing the cold-rolled steel sheet in a hot-dip galvanizing bath to form a hot-dip galvanized plating layer on a surface of the cold-rolled steel sheet.

6. The method for producing a steel sheet according to claim 5, further comprising:

heating the hot-dip galvanized steel sheet to a temperature range of 300° C. to 500° C. to alloy the plating layer.

* * * * *